US005956006A

United States Patent [19]

Sato

[11] Patent Number: 5,956,006

[45] **Date of Patent: *Sep. 21, 1999**

[54] LIQUID CRYSTAL DISPLAY APPARATUS AND METHOD OF DRIVING THE SAME, AND POWER SUPPLY CIRCUIT FOR LIQUID CRYSTAL DISPLAY APPARATUS

[75] Inventor: Soichi Sato, Ome, Japan

[73] Assignee: Casio Computer Co., Ltd., Tokyo, Japan

[ * ] Notice: This patent is subject to a terminal disclaimer.

[21] Appl. No.: 08/459,971

[22] Filed: Jun. 2, 1995

[30] Foreign Application Priority Data

Jun. 10, 1994 [JP] Japan ..... 6-151778
Jun. 10, 1994 [JP] Japan ..... 6-151785
Jun. 10, 1994 [JP] Japan ..... 6-151796

[51] Int. Cl.[6] ..... G09G 3/36

[52] U.S. Cl. ..... 345/88; 345/150

[58] Field of Search ..... 345/88, 89, 150, 345/153, 152; 395/131

[56] References Cited

U.S. PATENT DOCUMENTS 4,097,128 6/1978 Matsumoto et al. ..... 349/78
5,089,810 2/1992 Shapiro et al. ..... 345/150
5,365,252 11/1994 Lo ..... 345/153
5,416,890 5/1995 Beretta ..... 395/131
5,424,754 6/1995 Bar et al. ..... 345/150
5,489,918 2/1996 Mosier ..... 345/89
5,572,235 11/1996 Mical et al. ..... 345/150
5,576,723 11/1996 Asprey ..... 345/153
5,796,378 3/1995 Yoshida et al. ..... 345/152

FOREIGN PATENT DOCUMENTS

0457329 A2 11/1991 European Pat. Off. .
2617924 11/1976 Germany .
WO 94/10794 5/1994 WIPO .

*Primary Examiner*—Amare Mengistu
*Attorney, Agent, or Firm*—Frishauf, Holtz, Goodman, Langer & Chick, P.C.

[57] ABSTRACT

A CPU produces image data of RGB for defining a display image, and writes the image data in a memory. A display controller reads image data from the memory. A conversion table converts image data to voltage data corresponding to a voltage for displaying a color close to a color defined by the image data. The number of bits of voltage data is smaller than the number of bits of image data. The voltage data is converted by a D/A converter to an analog voltage which is in turn applied to an ECB type liquid crystal display device.

24 Claims, 20 Drawing Sheets

| ADDRESS | | | | | | STORED DATA |
|---|---|---|---|---|---|---|
| R1 | R2 | G1 | G2 | B1 | B2 | (VOLTAGE DATA) |
| 0 | 0 | 0 | 0 | 0 | 0 | 0 1 0 |
| 0 | 0 | 0 | 0 | 0 | 1 | 0 1 0 |
| 0 | 0 | 0 | 0 | 1 | 0 | 0 1 1 |
| | | | ⋮ | | | ⋮ |
| 1 | 1 | 1 | 1 | 1 | 1 | 1 0 1 |

FIG.4

19

| ADDRESS | | | | | | STORED DATA | | | | CORRESPONDING |
|---|---|---|---|---|---|---|---|---|---|---|
| R1 | R2 | G1 | G2 | B1 | B2 | (VOLTAGE DATA) | | | | VOLTAGE |
| 0 | 0 | 0 | 0 | 0 | 0 | 0 | 1 | 0 | 0 | V2 |
| 0 | 0 | 0 | 0 | 0 | 1 | 0 | 1 | 0 | 1 | (V2+V3) / 2 |
| 0 | 0 | 0 | 0 | 1 | 0 | 0 | 1 | 0 | 1 | (V2+V3) / 2 |
| 0 | 0 | 0 | 0 | 1 | 1 | 0 | 1 | 1 | 0 | V3 |
| ⋮ | | | | | | ⋮ | | | | ⋮ |
| 1 | 1 | 1 | 1 | 1 | 1 | 1 | 0 | 1 | 0 | V5 |

FIG.13

| | | | | | | | | | |
|---|---|---|---|---|---|---|---|---|---|
| C1 | C1 | C2 | C2 | C23 | C23 | C23 | C23 | C23 | C4 |
| C4 | C4 | C56 | C56 | C56 | C56 | C6 | C6 | C67 | C67 |
| C0 | C1 | C01 | C01 | C01 | C23 | C23 | C23 | C2 | C2 |

FIG.15A

| | | | | | | | | | |
|---|---|---|---|---|---|---|---|---|---|
| C1 | C1 | C2 | C2 | C2 | C3 | C2 | C3 | C2 | C4 |
| C4 | C4 | C5 | C6 | C5 | C6 | C6 | C6 | C6 | C7 |
| C0 | C1 | C0 | C1 | C0 | C2 | C3 | C3 | C2 | C2 |

FIG.15B

LIQUID CRYSTAL DISPLAY APPARATUS AND METHOD OF DRIVING THE SAME, AND POWER SUPPLY CIRCUIT FOR LIQUID CRYSTAL DISPLAY APPARATUS

BACKGROUND OF THE INVENTION

1. Field of the Invention

The present invention relates to a liquid crystal display (LCD) apparatus for displaying colors according to applied voltages, and a method of driving the same.

This invention also relates to a power supply circuit suitable for an LCD apparatus which displays colors according to applied voltages, and, more particularly, to an LCD apparatus which can easily execute the fine adjustment of display colors and a power supply circuit for this LCD apparatus.

2. Description of the Related Art

Color display apparatuses provide arbitrary display colors by combining primary colors of red, green and blue, and have dots corresponding to those primary colors. This type of color display apparatus displays arbitrary colors by independently controlling the brightness of the red, green and blue dots corresponding to the individual primary colors. Therefore, a television set, personal computer or the like, which is equipped with such a color display apparatus, supplies three pieces of luminance data corresponding to the primary colors of red, green and blue to the display apparatus and controls the brightness of the individual color dots in accordance with those luminance data of the primary colors, thereby displaying the desired color pixel by pixel.

In a color LCD device, likewise, electrodes forming a plurality of dots are arranged in such a manner that three dots corresponding to the color filters of the primary colors (red, green and blue) form a single pixel, and the intensities of light passing those dots are independently controlled to select the display color for each pixel formed by the three dots.

Since an LCD apparatus equipped with such color filters has a low light transmittivity, a transparent type which has a strong light source located at the back of the apparatus is employed in a television set, a personal computer, etc.

Because the aforementioned color LCD device suffers large light absorption by the color filters, however, a color LCD apparatus of a reflection type which utilizes the reflection of outside light cannot be provided.

An electrically controlled birefringence (ECB) type LCD device is known which can display a color image without using a color filter. The ECB type LCD device comprises a liquid crystal (LC) cell where liquid crystal is sealed, and two polarization plates arranged so as to sandwich the LC cell. The ECB type LCD device alters the molecular alignment of the liquid crystal by an applied electric field. When the molecular alignment changes, the birefringence of the LC layer changes and the polarization state of light passing the LC cell varies. Accordingly, the spectrum distribution of the light leaving the polarization plate on the outgoing side varies, displaying the desired color.

Since the ECB type LCD device does not cause light absorption by color filters, the display is bright. The ECB type LCD device can therefore be used as a reflection type color LCD device, and is still advantageous in its simple structure.

The ECB type LCD device provides display colors each in one-to-one association with the voltage applied between the electrodes constituting a single pixel. It is not therefore possible to activate and drive the ECB type LCD device with luminance data corresponding to the primary colors of red, green and blue supplied to the conventional color display apparatus like a CRT.

But, the number of colors that the conventional ECB type LCD device can display is limited to the number of applied voltages. As the displayed colors pass a predetermined locus on a chromaticity diagram with respect to a change in applied voltage, the number of display colors is limited. It is therefore difficult to obtain arbitrary display colors corresponding to the supplied luminance data of red, green and blue.

The number of voltages applicable to the ECB type LCD device from the driving circuit is limited. Each display color shows a sharp change and a gentle change in accordance with a change in applied voltage. The distance between displayable colors may become very large. To avoid this problem, it is necessary to increase the number of applicable voltages. Increasing the number of applicable voltages, however, complicates the circuit structure and adjustment of a power supply section and increases the manufacturing cost.

SUMMARY OF THE INVENTION

Accordingly, it is an object of the present invention to provide an ECB type LCD apparatus capable of presenting display colors specified by red, green and blue luminance data, and a method of driving the same.

It is another object of this invention to provide a color LCD device which selects from a set of displayable colors the colors closest to display colors specified by red, green and blue luminance data, and which displays the colors, and a method of driving the same.

It is a further object of this invention to provide an LCD apparatus capable of displaying colors which cannot be obtained by simple application of voltages when the types (number) of applicable voltages are limited, and a method of driving the same.

It is a still further object of this invention to provide an LCD apparatus capable of displaying a color which cannot be presented by a single pixel due to the structural restriction on an LCD device, and a method of driving the same.

It is a yet still further object of this invention to provide a birefringence control type LCD apparatus which ensures fine adjustment of display colors and is easy to adjust.

It is a yet still further object of this invention to provide a power supply circuit for an LCD device, which can easily provide desired voltages.

To achieve the above objects, an LCD apparatus according to the first aspect of this invention comprises:

a liquid crystal display device (31) for displaying a plurality of colors in accordance with applied voltages;

color designation means (11–17) for outputting image data (RGB) designating a display color of the liquid crystal display device (31);

conversion means (19) for memorizing relations between the image data and voltage data corresponding to the applied voltages, determined based on relations between display colors and the applied voltages, and converting the image data (RGB) to the voltage data corresponding to a display color designated by the image data (RGB), and outputting the voltage data; and drive means (21, 33, 35) for supplying a drive voltage (V0–V7) corresponding to the voltage data output from the conversion means (19) to the liquid crystal display device (31) to display the display color on the liquid crystal display device (31).

According to the second aspect of this invention, there is provided a liquid crystal display apparatus comprising:

a liquid crystal display device (31) having a plurality of pixels arranged in a matrix form, for displaying a color according to an applied voltage pixel by pixel;

a power supply circuit (61) for generating a plurality of voltages; and means (17, 19, 33, 62) for receiving image data, selecting a voltage corresponding to a display color from output voltages of the power supply circuit in accordance with the image data, and supplying the selected voltage to the liquid crystal display device, the power supply circuit including fixed voltage means (100) for producing a plurality of fixed voltages, variable voltage means (101, 102) having a voltage-dividing circuit including a variable impedance element (VR1, VR2), for producing a variable voltage, and output means (A) for outputting voltages, produced by the fixed voltage means (100) and the variable voltage means (100), as voltages for driving the liquid crystal display device (31).

According to the third aspect of this invention, there is provided a method of driving a liquid crystal display device which displays a color according to an applied voltage, comprising:

an image data output step of outputting image data defining a color to be displayed;

a first conversion step of converting the image data to corresponding voltage data to display the color defined by the image data;

a second conversion step of converting the voltage data to one of drive voltages to be applied to a liquid crystal of a liquid crystal display apparatus; and a drive step of supplying the drive voltage, obtained in the second conversion step, to the liquid crystal display device for displaying a color according to an applied voltage, thereby allowing the liquid crystal display device to display a color image.

BRIEF DESCRIPTION OF THE DRAWINGS

FIG. 4 is a diagram exemplifying the structure of a conversion table shown in FIG. 1;

FIG. 13 is a diagram showing the structure of a conversion table shown in FIG. 12;

FIG. 15A is a diagram showing one example of an image defined by output data of the conversion table, and FIG. 15B is a diagram showing one example of an image defined by output data of an intermediate color controller;

FIG. 17A shows a desired voltage to be output (voltage specified by voltage data output from the conversion table) and an actually output voltage (voltage output from a D/A converter), FIG. 17B shows a coincidence signal S output from a comparator shown in FIG. 16, FIG. 17C shows output data of a second latch and FIG. 17D shows actually displayed colors of individual pixels;

DETAILED DESCRIPTION OF THE PREFERRED EMBODIMENTS

Preferred embodiments of the present invention will now be described referring to the accompanying drawings.

First Embodiment

The structure of an electrically controlled birefringence (ECB) type LCD apparatus according to the first embodiment of this invention will be described with reference to FIG. 1.

Figure 1:
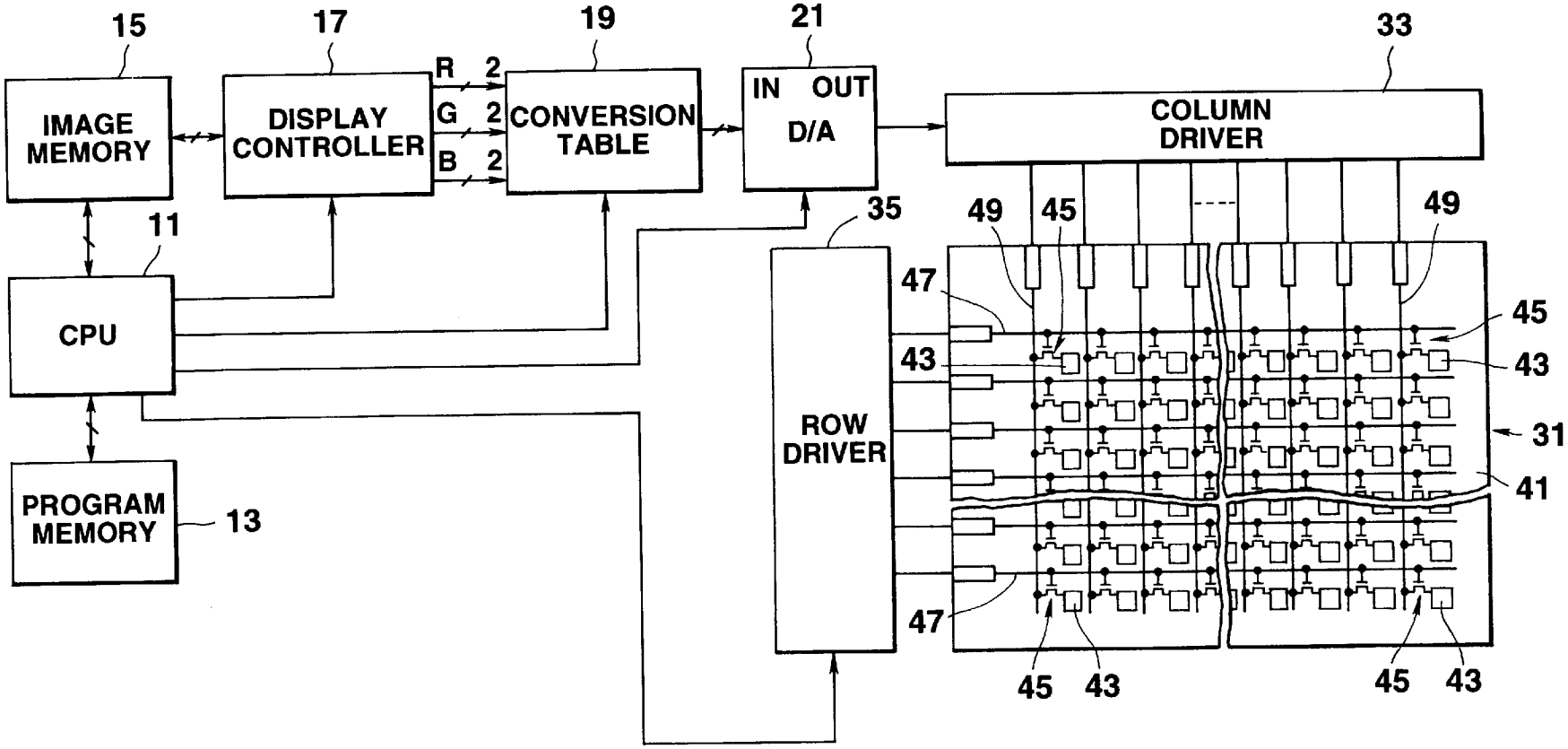
FIG. 1 is a circuit diagram of an LCD apparatus according to a first embodiment of the present invention.

As shown in FIG. 1, this LCD apparatus comprises a CPU 11, a program memory 13, an image memory (display memory) 15, a display controller 17, a conversion table 19, a D/A (Digital-to-Analog) converter 21, an ECB (Electrically Controlled Birefringence) type active matrix LCD device 31, a column driver (drain driver) 33, and a row driver (gate driver) 35. The CPU 11 controls the overall system in accordance with a predetermined program. The program memory 13 stores the operation program of the CPU 11, e.g., an image forming program. Image data is written in the image memory 15 by the CPU 11. The display controller 17 sequentially reads image data from the image memory 15 under the control of the CPU 11. The conversion table 19 converts the image data, read by the display controller 17, to 3-bit digital voltage data for each pixel. The D/A converter 21 converts the voltage data, output from the conversion table 19, to an analog voltage. The column driver 33 samples the output signals of the D/A converter 21 and supplies the sampled signals to transparent pixel electrodes 43 via thin film transistors (hereinafter referred to as TFTs) 45. The row driver 35 serves to turn on the TFTs 45.

Figure 2:
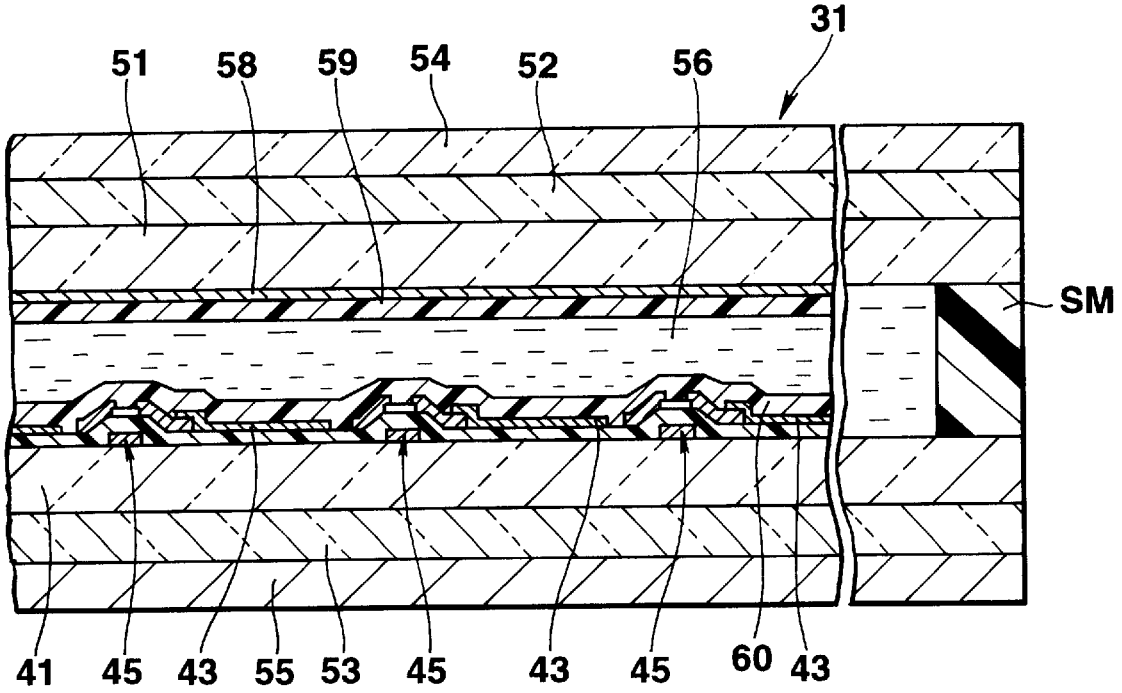
FIG. 2 is a cross-sectional view of the essential portions of an LCD device shown in FIG. 1.

As shown in FIG. 2, the LCD device 31 comprises a pair of transparent substrates 41 and 51 (e.g., glass substrates), a liquid crystal 56, a retardation plate 52, a pair of polarization plates 53 and 54, and a reflector 55. The substrates 41 and 51 face each other with a seal member SM in between. The liquid crystal 56 is arranged between both substrates 41 and 51. The retardation plate 52 is located on the transparent substrate 51. Those components 41, 51, 56 and 52 are sandwiches between the polarization plates 53 and 54.

The pixel electrodes 43 and TFTs 45 having sources connected to the pixel electrodes 43 are arranged in a matrix form on the substrate 41 as shown in FIGS. 1 and 2. Gate lines (address lines) 47 are arranged in a row direction, and each gate line 47 is connected to the gate electrodes of the associated row of TFTs 45, as shown in FIG. 1. Data lines (color signal lines) 49 are arranged in a column direction, and each data line 49 is connected to the drains of the associated column of TFTs 45. An alignment film 60 having undergone a predetermined aligning process is provided on the pixel electrodes 43 and the TFTs 45, as shown in FIG. 2. The polarization plate 53 is located at the back of the substrate 41, and the reflector 55 made of metal, such as aluminum, is provided at the back of the polarization plate 53.

A transparent opposing electrode 58 opposing the individual pixel electrodes 43 is formed on the substrate 51. An alignment film 59 having undergone a predetermined aligning process is provided on the opposing electrode 58. The retardation plate 52 is provided on the top surface of the substrate 51. The polarization plate 54 is provided on the top surface of this retardation plate 52.

Both substrates 41 and 51 are adhered via the frame-shaped seal member SM. The liquid crystal 56 is, for example, a nematic liquid crystal having the positive dielectric anisotropy. The liquid crystal 56 is sealed in a twisted state in the area surrounded by both substrates 41 and 51 and the seal member SM.

The alignment direction of the LC molecules in the vicinity of the alignment film 59 is shifted about 90, or 200 to 270 degrees counterclockwise, for example, as viewed from the top with respect to the alignment direction of the LC molecules in the vicinity of the alignment film 60 (azimuth of 0 degree).

The transmission axis of the polarization plate 54 extends in the direction of 30 degrees with respect to the azimuth of 0 degree as viewed from the above. The transmission axis of the polarization plate 53 extends in the direction of 50 degrees with respect to the azimuth of 0 degree as viewed from the observing side. The phase delay axis of the retardation plate 52 is inclined to the transmission axis of the polarization plate 54.

The LCD device 31 is of a reflection type. The incident light to this device 31 passes the polarization plate 54, the retardation plate 52, the liquid crystal 56 and the polarization plate 53 in order, and is then reflected at the reflector 55. The reflected light sequentially passes the polarization plate 53, the liquid crystal 56, the retardation plate 52 and the polarization plate 54 and then leaves the device 31.

The phase delay axis of the retardation plate 52 is inclined to the transmission axis of the polarization plate 54. The linearly polarized light passing the polarization plate 54 becomes elliptically polarized light whose light components of individual wavelengths have different polarized states due to the birefringence effect while passing the retardation plate 52. This elliptically polarized light changes its polarized state by the birefringence effect while passing the liquid crystal 56, and reaches the polarization plate 53. Only the component of the light of each wavelength in the direction of the transmission axis of the polarization plate 53 passes the polarization plate 53, and is reflected at the reflector 55.

This reflected light undergoes the polarizing effect and birefringence effect while sequentially passing the polarization plate 53, the liquid crystal 56 and the retardation plate 52. The light then enters the polarization plate 54. Of the light having entered the polarization plate 54, only the polarized component in the direction of the transmission axis of the polarization plate 54 passes the polarization plate 54. As a result, the color according to the wavelength distribution of the transmitted light is displayed. The birefringence of the liquid crystal 56 changes in accordance with the voltage applied to the liquid crystal 56. The spectrum distribution of the outgoing light changes in accordance with a change in birefringence. The display of the LCD device 31 therefore changes in accordance with the voltage applied to the liquid crystal 56 (i.e., the voltage between the pixel electrode 43 and opposing electrode 58).

Figure 3:
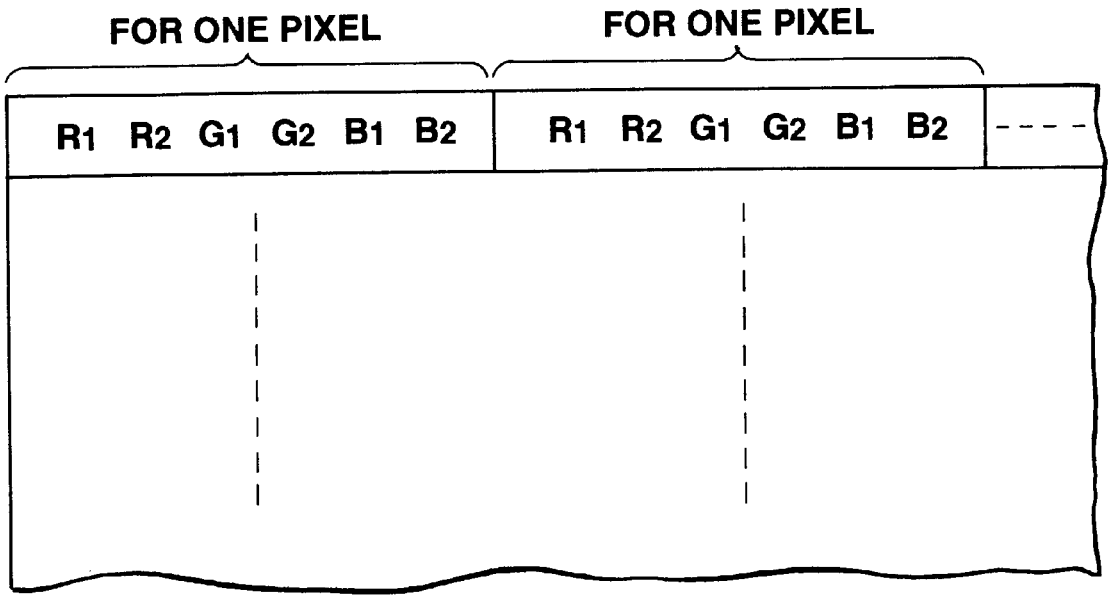
FIG. 3 is a diagram showing an example of image data to be stored in an image memory shown in FIG. 1.

The image data, produced by the CPU 11 and stored in the image memory 15, consists of, for example, 6-bit data per pixel as shown in FIG. 3. The upper two bits of the image data expresses the luminance of red (R), the next two bits expresses the luminance of green (G) and the last two bits expresses the luminance of blue (B). The combined color of those three colors corresponds to the desirable color that is to be displayed at each pixel.

The display controller 17 sequentially reads image data from the image memory 15 pixel by pixel and outputs the image data to the conversion table 19 under the control of the CPU 11.

As shown in FIG. 4, the conversion table 19 stores voltage data indicative of voltages to be applied to each pixel in order to display the color, indicated by the image data, in each memory area expressed by the image data as an address. The conversion table 19 outputs voltage data for each pixel, stored at the location addressed by the image data supplied from the display controller 17.

When the image data is "000000," for example, a voltage V2 corresponding to voltage data "010" is applied to the associated pixel (more specifically, between the pixel electrode 43 and the opposing electrode 58). When the image data is "000001," for example, a voltage V2 corresponding to voltage data "010" is applied to the associated pixel. When the image data is "000010," for example, a voltage V3 corresponding to voltage data "011" is applied to the associated pixel.

The voltage data stored in the conversion table 19 may be set as follows.

Figure 5:
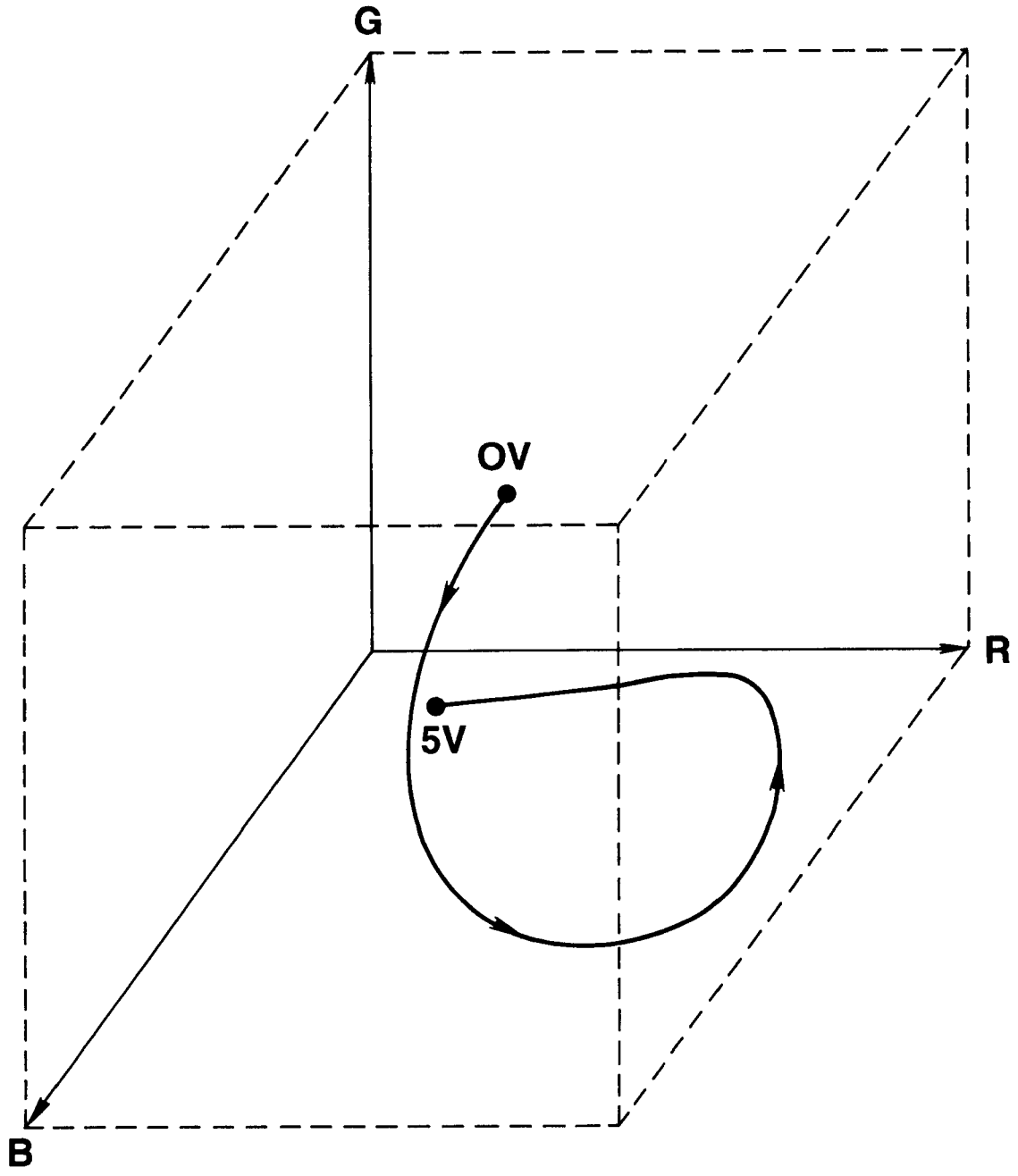
FIG. 5 is an RGB chromaticity diagram exemplifying the relation between applied voltages and display colors of the LCD device.

First, the characteristic of the LCD device 31 (characteristic of a change in display color with respect to the applied voltage) is obtained as indicated in the RGB color space in FIG. 5, for example. Then obtained eight colors C0 to C7, which are displayed when eight voltages V0 (lowest) to V7 (highest) outputtable from the D/A converter 21 are applied. V0 to V7 are voltages with respect to the voltage of the opposing electrode 58.

Figure 6:
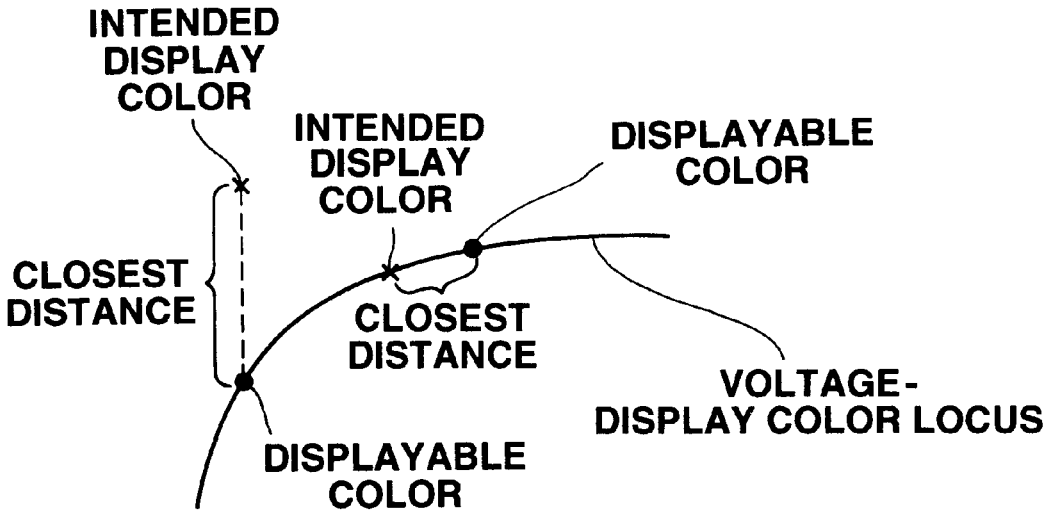
FIG. 6 is a diagram for explaining a scheme for setting voltage data corresponding to colors which cannot be displayed.

For each of 64 ($2^2 \times 2^2 \times 2^2$) colors defined by 6-bit image data, the colors to be displayed to approximate that color is selected from the eight colors C0–C7. When there is no associated color, a displayable color located closest in the RGB color space is selected as shown in, for example, FIG. 6, and voltage data corresponding to this color is set in the associated memory area.

Then, the voltage data corresponding to the selected display color is set in the associated memory area in the conversion table 19.

Figure 7:
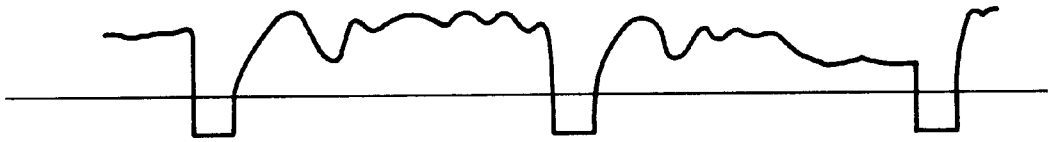
FIG. 7 is a diagram exemplifying the output signal of a D/A converter.

The D/A converter 21 receives 3-bit voltage data from the conversion table 19, converts this voltage data to an analog voltage signal of 0 V to 5 V and outputs this signal all under the control of the CPU 11. The D/A converter 21 outputs a signal of a predetermined level in each horizontal sync period under the control of the CPU 11. Accordingly, the analog video signal output from the D/A converter 21 has a waveform as shown in FIG. 7.

The column driver 33 samples one line of analog video signals supplied from the D/A converter 21, and sends the video signal, sampled previously by one horizontal scan period, to the associated data line 49.

The row driver 35 sequentially applies a gate pulse of a predetermined pulse width to the gate lines 47 in accordance with the timing signal from the CPU 11. The TFTs 45 connected to the gate line 47 to which the gate pulse is applied is turned on. Voltages (write voltages) V0–V7 corresponding to display colors are applied to the pixel electrodes 43 connected to the activated TFTs 45.

The row driver 35 disables the gate pulse immediately before the voltage applied to the data line 49 is switched. Then, the TFTs 45 connected to the gate line 47 are turned off, and the write voltages applied up to that point are held in the capacitors (pixel capacitors) formed by the pixel electrodes 43, the opposing electrode 58 and the liquid crystal 56 lying between both electrodes 43 and 58.

The voltages held in the pixel capacitors maintain the alignment states of the LC molecules to keep the desired display colors.

The operation of the LCD apparatus shown in FIG. 1 will be described below.

The CPU 11 executes the program stored in the program memory 13, and properly writes image data defining an image to be displayed in the image memory 15. The image data represents a color to be displayed. At the stage of preparing the programs to be executed by the CPU 11, it is unnecessary to know the characteristic and the like of the LCD device to be used. Nor is it necessary to particularly consider the characteristic. Therefore, a programmer can prepare the programs only in consideration of the operation of the CPU 11 and the colors of images to be displayed.

The display controller 17 reads image data, written in the image memory 15 by the CPU 11, pixel by pixel (six bits each) by for each scan line, and sequentially supplies the image data to the address terminals of the conversion table 19. Stored at the location addressed by the image data from the conversion table 19 is 3-bit voltage data corresponding to the image data. The conversion table 19 reads the voltage data and supplies the data to the D/A converter 21.

The D/A converter 21 converts the 3-bit voltage data, sequentially supplied from the conversion table 19, to an analog voltage, and outputs it as an analog video signal as shown in FIG. 7.

The column driver 33 samples the video signal for one line, supplied from the D/A converter 21, and outputs the sampled signals to the data line 49 in the next horizontal scan period.

The row driver 35 sequentially applies the gate pulse to the gate lines 47 in accordance with the timing signal from the CPU 11 to sequentially select (scan) the pixel electrodes 43. Voltages corresponding to the display colors are applied via the data line 49 and the TFTs 45 to the selected row of pixel electrodes 43. The voltages may correspond to the colors which are intended to be displayed, or may correspond to displayable colors close to the colors which are intended to be displayed.

The row driver 35 disables the gate pulse immediately before the voltage applied to the data line 49 is switched. Consequently, the associated TFTs 45 are turned off, and the write voltages are held in the capacitors formed by the pixel electrodes 43, the opposing electrode 58 and the liquid crystal 56 lying between both electrodes 43 and 58. Therefore, the alignment states of the LC molecules in a non-selection period are kept to the desired states, and the desired birifringence is maintained, thereby keeping the display colors.

By repeating the above operation, an image substantially identical to the image defined by the image data stored in the image memory 15 is displayed on the LCD device 31.

According to this embodiment, as described above, the proper color image can be displayed on the ECB LCD device based on RGB image data. Even a color the ECB LCD device cannot display is designated, a displayable color close to the designated one is properly selected and displayed.

In creating a display program to be stored in the program memory 13, a programmer need not consider the "applied voltage v.s. display colors characteristic of the LCD device 31, but should consider only color images that may be displayed. This therefore facilitates the preparation of programs.

Even when the LCD devices 31 of different characteristics are available, arbitrary color images can be prepared in accordance with the characteristic of the LCD device in use by simply altering the stored data in the conversion table 19 without amending the display program itself.

Figure 8:
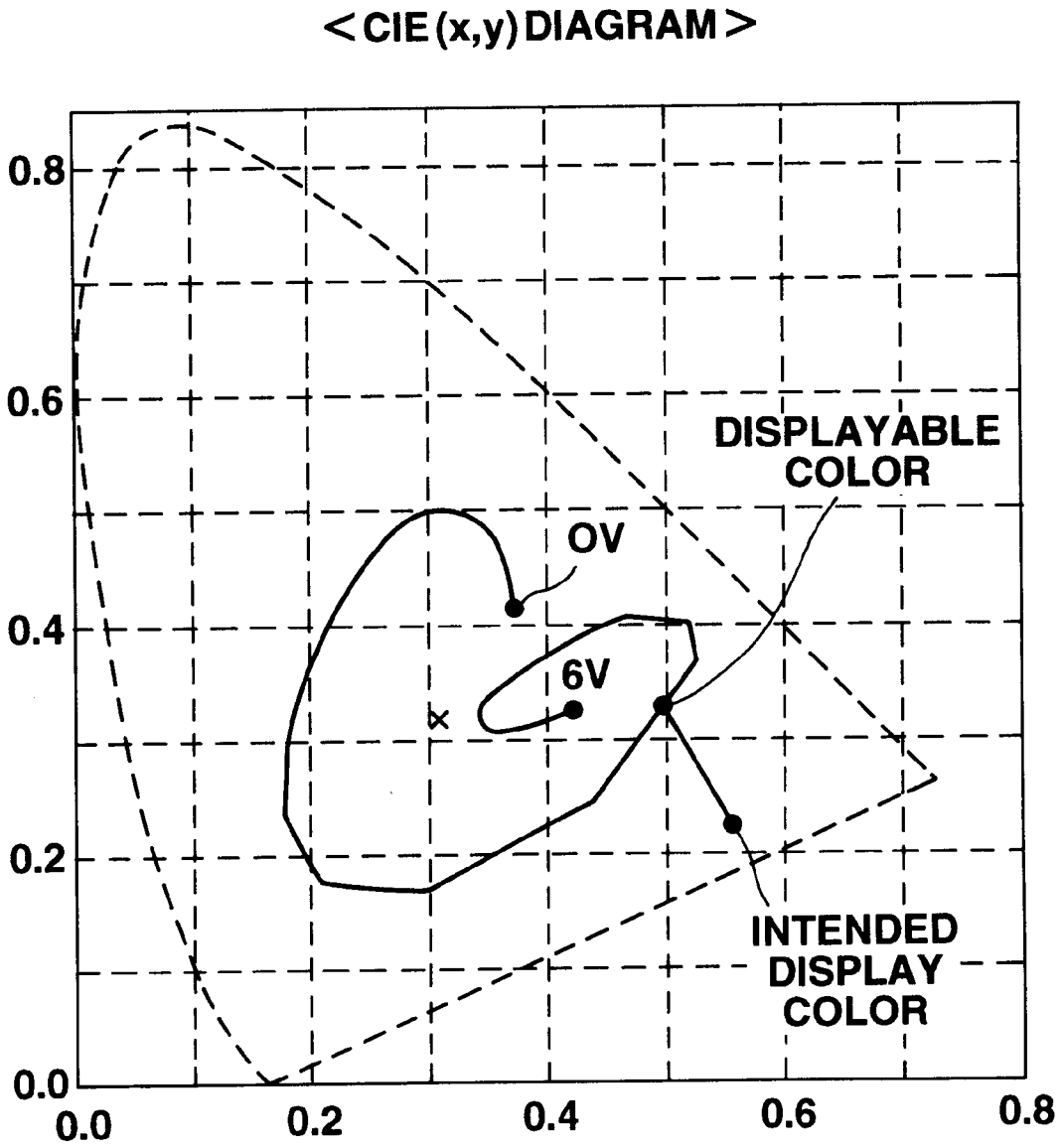
FIG. 8 is a CIE chromaticity diagram showing an example of the relation between applied voltages and display colors of the LCD device.
Figure 9:
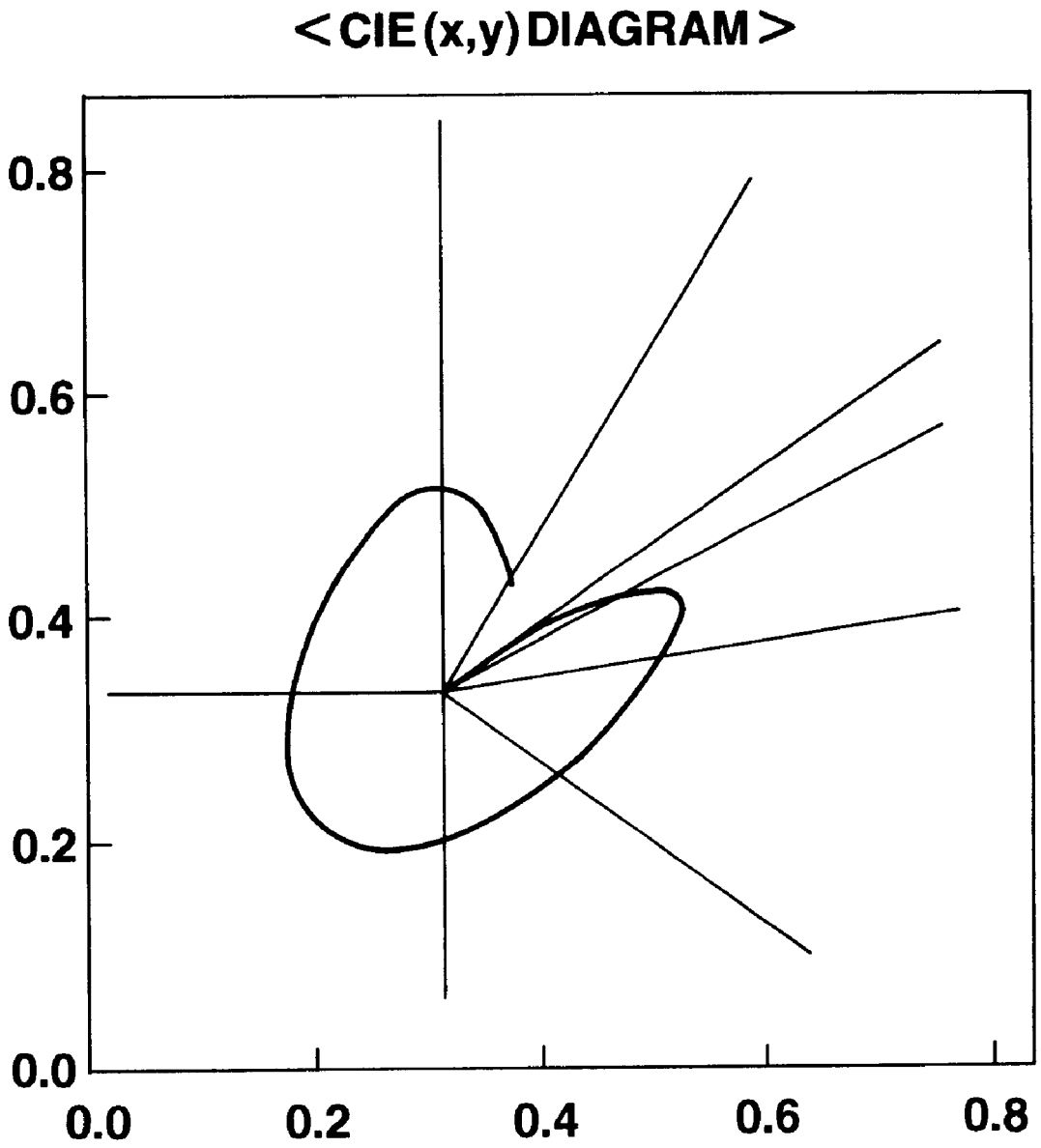
FIG. 9 is a diagram for explaining a scheme for setting voltage data corresponding to colors which cannot be displayed.

Although the contents of the conversion table 19 are set on the basis of the applied voltages and display colors on the RGB chromaticity diagram, the contents of the conversion table 19 may be set on the basis of the locus of the display colors on the CIE chromaticity diagram shown in FIG. 8. In this case, for colors that cannot be displayed, voltage data corresponding to displayable colors closest to the undisplayable colors on the chromaticity diagram should be set in the conversion table. Alternatively, the chromaticity diagram may be separated radially with white points as reference points, so that colors belonging to each segmented area can be replaced with displayable colors within that segmented area, as shown in FIG. 9.

When the ECB LCD devices 31 of different characteristics are to be used, arbitrary color images can be prepared in accordance with the characteristic of the LCD device in use by simply changing the voltages to be generated and without amending the display program itself.

Second Embodiment

Although a voltage to be applied to each pixel is obtained by the D/A conversion of the output data of the conversion table 19 in the first embodiment, for example, one of voltages previously produced, may be selectively output instead in accordance with the output data of the conversion table 19.

Figure 10:
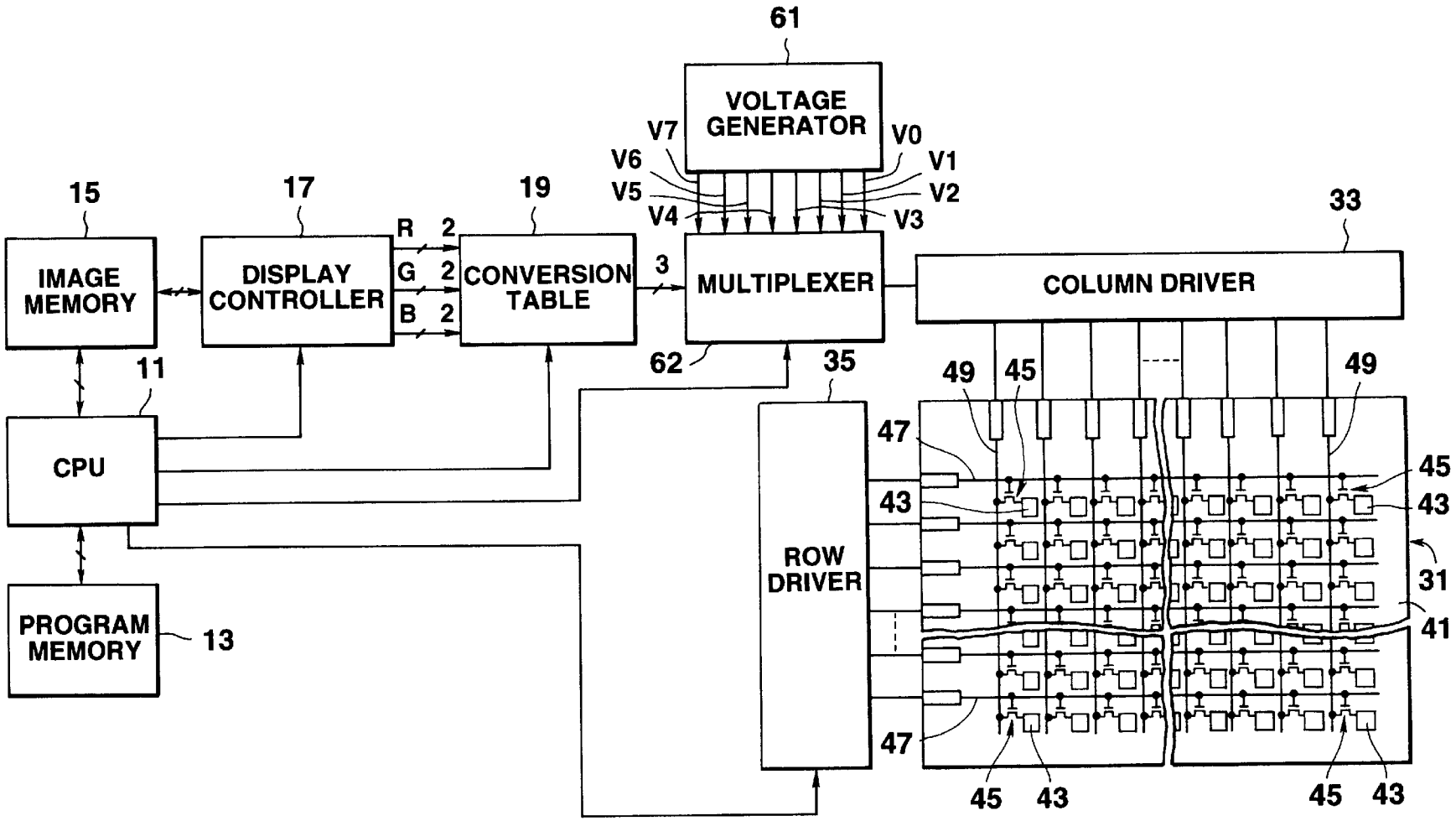
FIG. 10 is a circuit diagram of an LCD apparatus according to a second embodiment of this invention.

FIG. 10 shows the circuit structure of an ECB type LCD apparatus designed in such a way.

The basic structure of this LCD apparatus is the same as the circuit structure of the LCD apparatus of the first embodiment shown in FIG. 1. It is to be noted however that the D/A converter 21 is replaced with a voltage generator 61 for producing eight types of predetermined voltages V0 to V7 and a multiplexer 62 which selectively outputs one of the eight voltages V0–V7, produced from the voltage generator 61, in accordance with the output of the conversion table 19.

The operation of the LCD apparatus shown in FIG. 10 will be described below.

The display controller 17 reads image data, written in the image memory 15 by the CPU 11, pixel by pixel (six bits each) by for each scan line, and sequentially supplies the image data to the address terminals of the conversion table 19. The conversion table 19 stores voltage data shown in FIG. 4 and outputs 3-bit voltage data corresponding to image data to the multiplexer 62.

The multiplexer 62 selects one of the voltages from the voltage generator 61, in accordance with the 3-bit selection data, sequentially supplied from the conversion table 19, and outputs the selected voltage as an analog video signal as shown in FIG. 7.

The column driver 33 samples one line of video signals, supplied from the multiplexer 62, and outputs the sampled signals to the data line 49 in the next horizontal scan period, as in the first embodiment.

The row driver 35 sequentially applies the gate pulse to the gate lines 47 to turn on the associated row of TFTs 45 as in the first embodiment. Consequently, write voltages are applied to the liquid crystal.

The row driver 35 disables the gate pulse immediately before the voltage applied to the data line 49 is switched. Consequently, the TFTs 45 connected to the gate line whose input gate pulse has been disabled are turned off, causing the write voltages to be held in the capacitors formed by the pixel electrodes 43, the opposing electrode 58 and the liquid crystal 56 lying therebetween. Therefore, the alignment states of the LC molecules in a non-selection period are kept to the desired states, and the desired birefringence is maintained, thereby keeping the display colors.

According to this embodiment, as described above, the proper color image can be displayed on the ECB LCD device based on RGB luminance signals too.

In this embodiment, the contents of the conversion table 19 may be set on the basis of the relation between the applied voltages and display colors on the RGB chromaticity diagram or the locus of the display colors on the CIE chromaticity diagram, too.

According to this invention, as apparent from the above description, any designated display color is automatically converted to the associated voltage, so that the proper color image can be displayed on the LCD device. Even when a color the LCD device cannot display is designated, a displayable color close to the designated color is selected and is automatically converted to the associated voltage, so that the proper color display image can be obtained.

When the LCD devices of different characteristics are to be used, arbitrary color images can be prepared in accordance with the characteristic of the LCD device in use by simply changing the voltages to be generated and without amending the display program itself.

Third Embodiment

Figure 11:
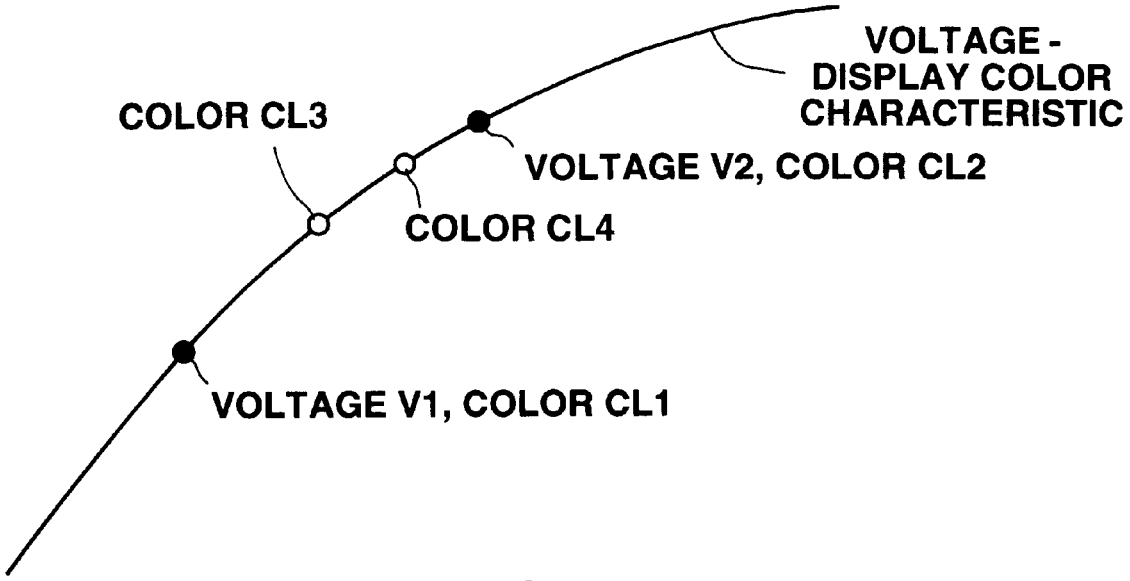
FIG. 11 is a diagram showing the relation among voltages to be applied to an LCD device, colors displayable by the applied voltages and intermediate colors between the displayable colors.

Given that voltages to be applied to an ECB type LCD device, which shows a voltages-display colors characteristic as shown in FIG. 11, are V1 and V2 and display colors for those voltages are CL1 and CL2, if this characteristic can be approximated substantially to a straight line, an intermediate color CL3 between the colors CL1 and CL2 can approximately be expressed by the mixture of colors of a plurality of pixels by alternately arranging the pixel with the color CL1 and the pixel with the color CL2.

Likewise, a color CL4, which lies between the colors CL3 and CL2 on the voltages-display colors characteristic chart, can approximately be expressed by sequentially arranging one pixel with the color CL1 and three pixels with the color CL2.

Because of the limitation to the number of voltages to be applied to each pixel of the LCD device, therefore, a color which cannot be displayed by each pixel alone is approximated to a color obtained by mixing the display colors of a plurality of pixels in this embodiment.

Figure 12:
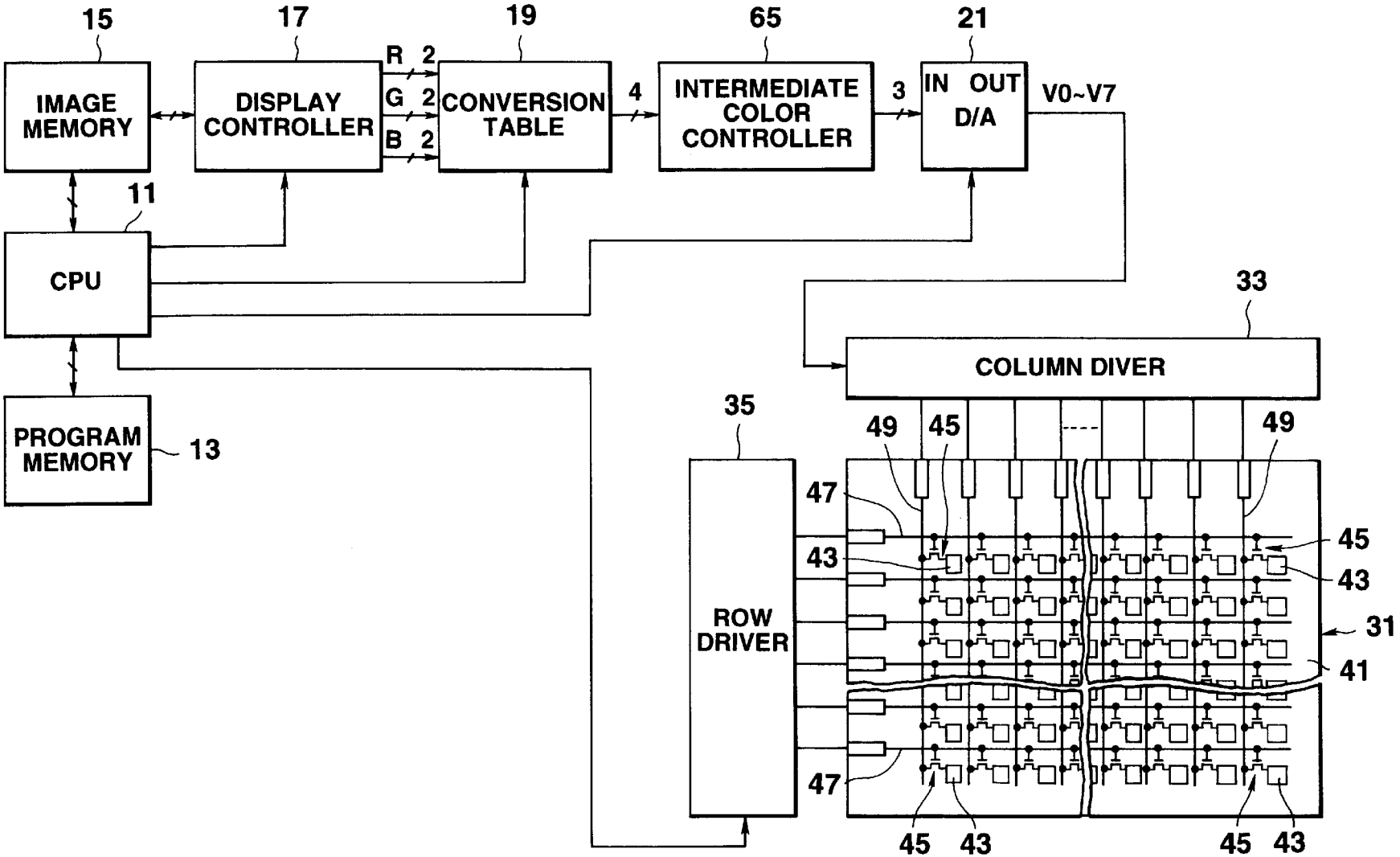
FIG. 12 is a circuit diagram of an LCD apparatus according to a third embodiment of this invention.

The structure of the ECB type LCD apparatus of this embodiment will now be discussed with reference to FIG. 12.

In this embodiment, like in the first and second embodiments, eight voltages V0 to V7 are actually applicable to the individual pixels of the LCD device and 15 colors can be displayed by mixing the colors of a plurality of pixels.

The basic structure of this LCD apparatus is the same as that of the first embodiment. It is to be noted however that the conversion table 19 stores 4-bit voltage data corresponding to image data read by the display controller 17. Provided between the conversion table 19 and the D/A converter 21 (which may be the multiplexer 52) is an intermediate color controller 65 which converts the 4-bit voltage data from the conversion table 19 to 3-bit voltage data.

In this embodiment, the stored data (voltage data) in the conversion table 19 is set, for example, as follows.

Figure 14:
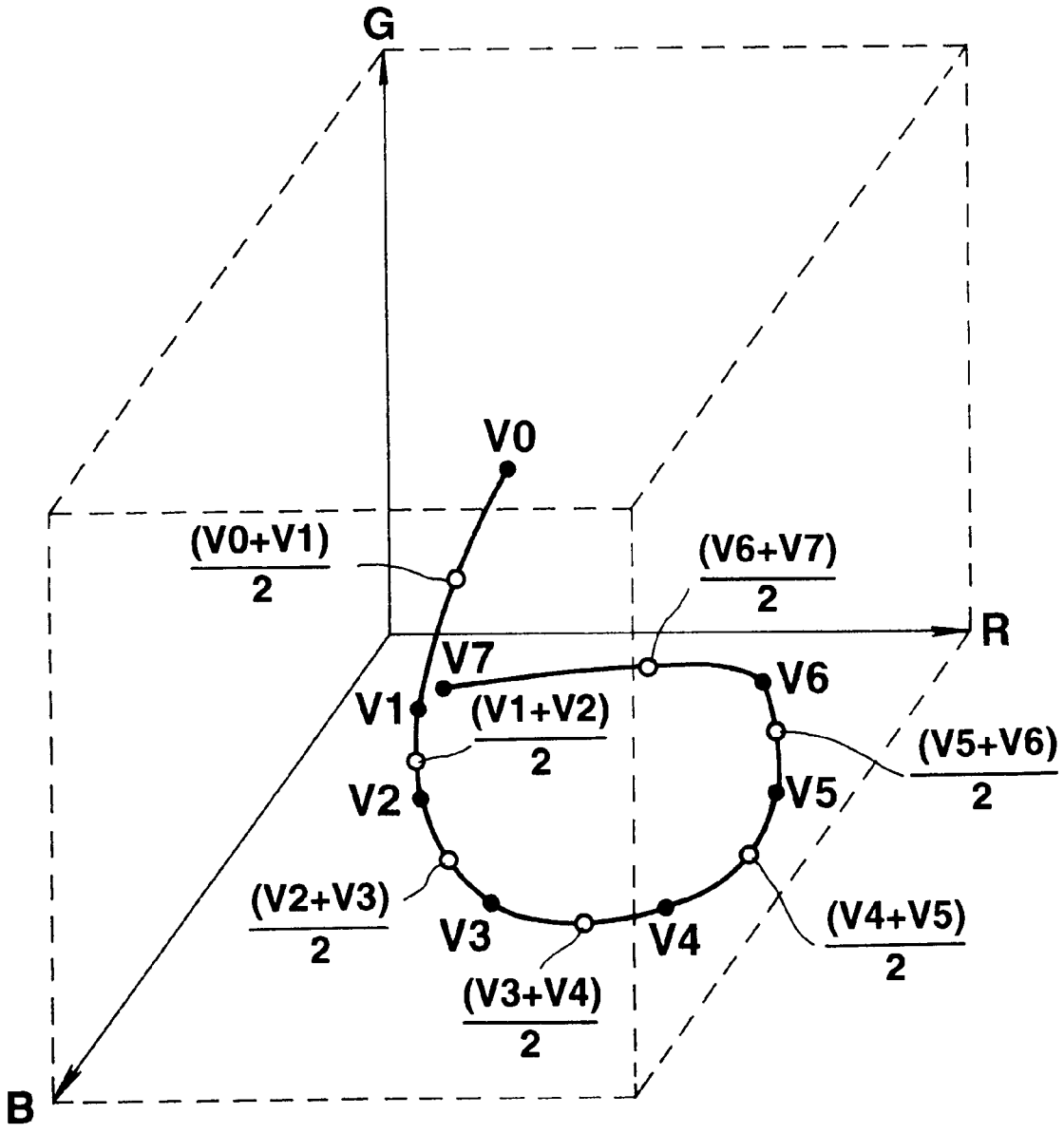
FIG. 14 is an RGB chromaticity diagram exemplifying the relation between applied voltages and display colors of an LCD device, for explaining a scheme for setting voltage data corresponding to colors which cannot be displayed.

First, the characteristic of the ECB type LCD device 31 in use (the characteristic of a change in the display color of a pixel with respect to an applied voltage) is obtained as shown in the RGB chromaticity space in FIG. 14, for example.

Then obtained are eight colors which are displayed when eight voltages V0 (minimum) to V7 (maximum) outputtable from the D/A converter 21 are applied. Further obtained are seven intermediate colors which are displayed when intermediate voltages (V0+V1)/2 to (V6+V7)/2 are applied.

For the actually displayable eight colors, the associated voltage data are set to "0000" to "1110" with their LSB set to "0." For the intermediate colors, the associated voltage data are set to "0001" to "1101" with their LSB set to "1."

Next, for each of 64 ($2^2 \times 2^2 \times 2^2$) colors defined by a total of six bits, the closest color is obtained from the aforementioned 15 colors and 4-bit voltage data corresponding to this display color is set in the associated memory area in the conversion table 19.

When supplied with any of voltage data "0000" to "1110" corresponding to the colors which can be displayed pixel by pixel, the intermediate color controller 65 outputs 3-bit voltage data for displaying that color.

When one piece of voltage data "0001" to "1101," corresponding to the intermediate colors which cannot be displayed pixel by pixel, is supplied to the intermediate color controller 65 from the conversion table 19, the intermediate color controller 65 outputs 3-bit voltage data for displaying a displayable color close to the intermediate color. When some pieces of voltage data "0001" to "1101" are continuously supplied to the intermediate color controller 65, the intermediate color controller 65 outputs 3-bit voltage data for displaying displayable colors on both sides of the intermediate color, thereby displaying the designated intermediate color by the mixed color.

More specifically, when supplied with voltage data with the LSB of "0" or voltage data "XXX0," the intermediate color controller 65 outputs data "XXX" which consists of the upper three bits of the received data. When supplied with a single piece of voltage data with the LSB of "1" or voltage data "XXX1," the intermediate color controller 65 outputs data "XXX" which consists of the upper three bits of the received data. When continuously supplied with pieces of voltage data with the LSB of "1" or voltage data "XXX1," the intermediate color controller 65 alternately outputs data "XXX," which consists of the upper three bits of the received data, and data "XXX+001." Accordingly, the average value of the voltages applied to two adjoining pixels becomes substantially equal to the voltage specified by the 4-bit voltage data output from the conversion table 19.

The D/A converter 21 receives 3-bit voltage data from the intermediate color controller 65 and converts the data to any of eight levels of voltages V0 to V7 within the range of 0 V to 5 V, under the control of the CPU 11.

The operation of the LCD apparatus shown in FIG. 12 will be described below.

The display controller 17 reads image data from the image memory 15 pixel by pixel (six bits each) by for each scan line, and sequentially supplies the image data to the address terminals of the conversion table 19. The conversion table 19 reads 4-bit voltage data stored at the location addressed by the image data, and supplies the voltage data to the intermediate color controller 65.

When supplied with voltage data with the LSB of "0" from the conversion table 19, the intermediate color controller 65 extracts and outputs the upper three bits of the received data. When supplied with a single piece of voltage data with the LSB of "1," the intermediate color controller 65 extracts and outputs the upper three bits of the received data. When continuously supplied with pieces of voltage data with the LSB of "1," the intermediate color controller 65 alternately outputs data consisting of the upper three bits of the received data and data obtained by adding "001" to those upper three bits.

When the colors of the individual pixels defined by image data output from the conversion table 19 are arranged as shown in FIG. 15A, the image defined by the 3-bit voltage data output from the intermediate color controller 65 becomes as shown in FIG. 15B.

In FIGS. 15A and 15B, C0–C7 indicate colors to be displayed when the voltages V0–V7 are applied, and C01–C67 indicate the intermediate colors from the intermediate color between C0 to C1 to the one between C6 and C7.

The D/A converter 21 converts the 3-bit voltage data, sequentially supplied from the intermediate color controller 65, to an analog voltage, and outputs it as an analog video signal as shown in FIG. 7.

By repeating the above operation, pixels of colors close to intermediate colors are alternately arranged at the portion where the intermediate color are continuously specified, as shown in FIGS. 15A and 15B. Those colors are visually mixed and their intermediate colors or the colors which have been intended to be displayed are displayed on the LCD device 31.

One example of the specific structure of the intermediate color controller 65 will be described below with reference to FIG. 16.

Voltage data Dt consisting of m+α bits (m=3, α=1), output from the conversion table 19, is supplied to a first latch 71, a comparator 73 and an adder 75. The first latch 71 delays the input data by one clock period (one pixel period).

Voltage data Dt-1, which is the voltage data Dt delayed by one clock period by the first latch 71, is also supplied to the comparator 73. The comparator 73 outputs a coincidence signal S of a level "1" when two input data coincide with each other, and outputs a coincidence signal S of a level "0" when both input data do not coincide with each other.

The adder 75 receives the voltage data Dt output from the conversion table 19 and data from a second latch 79, which will be discussed later. The adder 75 adds two input data and outputs the resultant data when the coincidence signal S has the level "1" and directly outputs the voltage data Dt, output from the conversion table 19, when the coincidence signal S has the level "0."

A rounding unit 77 extracts upper m bits from (m+α)-bit data supplied from the adder 75 and outputs those bits as data dt to the D/A converter 21, and extracts lower α bits from the (m+α)-bit data supplied from the adder 75 and outputs those bits to the second latch 79.

The operation of the intermediate color controller 65 shown in FIG. 16 will be described below referring to FIGS. 17A through 17D.

Figure 17A:
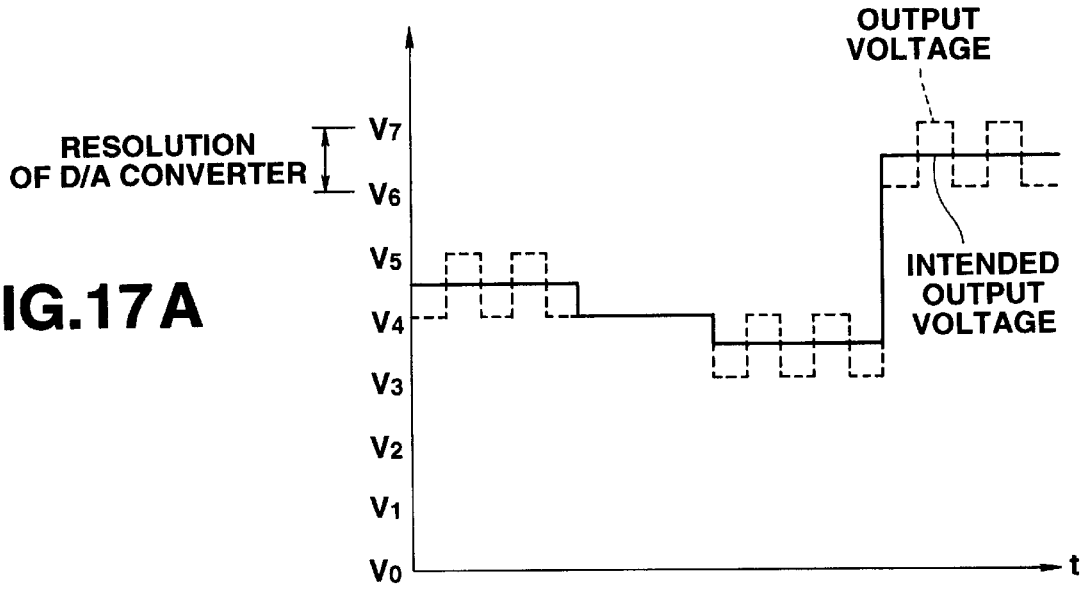
FIGS. 17A through 17D are timing charts for explaining the operation of the intermediate color controller shown in FIG. 16.

In FIG. 17A, the solid line indicates voltages specified by 4-bit voltage data output from the conversion table 19 (voltages corresponding to the colors intended to be displayed), namely any of the voltages V0–V7 actually applicable to the liquid crystal and their intermediate values. The broken line indicates voltages specified by 3-bit voltage data output from the rounding unit 77, namely any of the voltages V0–V7 outputtable from the D/A converter 21.

Figure 17B:
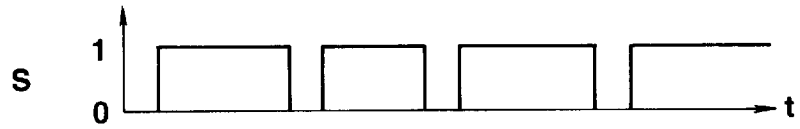
Figure 17C:
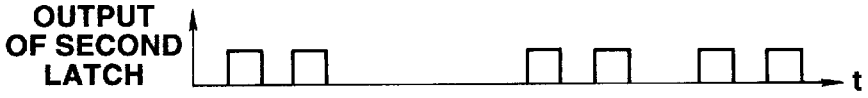
Figure 17D:
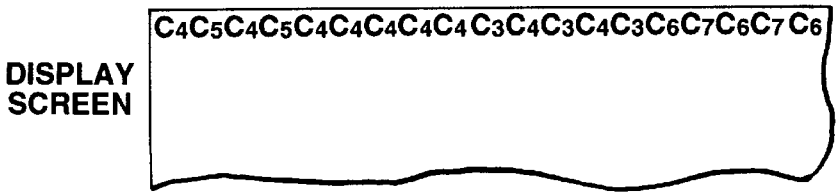

FIG. 17B indicates the coincidence signal S output from the comparator 73, FIG. 17C indicates the output data of the second latch 79, and FIG. 17D indicates the colors of the individual pixels to be displayed.

In the initial state, the output signal S of the comparator 73 has a level "0" as shown in FIG. 17B, and the adder 75 directly outputs 4-bit voltage data output from the conversion table 19, e.g., "1001." The rounding unit 77 extracts the upper 3 bits "100" from the output of the adder 75 and supplies those bits to the D/A converter 21. The D/A converter 21 converts the voltage data "100" to an analog voltage V4, as shown in FIG. 17A, and supplies it to the column driver 33. Consequently, the display color of the associated pixel becomes the color C4 corresponding to the voltage V4 as shown in FIG. 17D. The rounding unit 77 supplies the LSB "1" of the 4-bit voltage signal "1001" to the second latch 79. Therefore, the output of the second latch 79 becomes "1" as shown in FIG. 17C.

When the voltage data "1001" is read again from the conversion table 19, the previous voltage data held in the first latch 71 matches with the current voltage data and the comparator 73 outputs the coincidence signal S of the level "1" as shown in FIG. 17B. In accordance with this coincidence signal S, the adder 75 adds the voltage data "1001" from the conversion table 19 and the data "1" held in the second latch 79, and outputs the resultant data "1010." The rounding unit 77 extracts the upper 3 bits "101" from the data "1010" and supplies the voltage data "101" to the D/A converter 21. The D/A converter 21 converts the voltage data "101" to an analog voltage V5 as shown in FIG. 17A, and supplies the analog voltage V5 to the column driver 33. Consequently, the display color of the associated pixel becomes the color C5 corresponding to the voltage V5 as shown in FIG. 17D. The rounding unit 77 supplies the LSB "0" of the data "1010" to the second latch 79, which latches the input data as shown in FIG. 17C.

When the voltage data "1001" is read again from the conversion table 19, the comparator 73 outputs the coincidence signal S of the level "1" as shown in FIG. 17B. The adder 75 adds the voltage data "1001" from the conversion table 19 and the data "0" held in the second latch 79, and outputs the resultant data "1001." The rounding unit 77 extracts the upper 3 bits "100" from the data "1001" and supplies the voltage data "100" to the D/A converter 21. The D/A converter 21 supplies the analog voltage V4 to the column driver 33. Consequently, the display color of the associated pixel becomes the color C4 corresponding to the voltage V4 as shown in FIG. 17D. The rounding unit 77 supplies the LSB "1" of the data "1001" to the second latch 79, which latches the input data as shown in FIG. 17C.

As a similar operation is repeated and every time the conversion table 19 continuously outputs the 4-bit voltage data "1001," the D/A converter 21 supplies the voltages V4 and V5 to the column decoder 33 in order. The column decoder 33 samples the supplied voltages V4 and V5 and applies the sampled voltages to the associated pixel electrodes 43. Consequently, the pixels for the color C4 and the pixels for the color C5 are alternately arranged as shown in FIG. 17D and the intermediate color C45 is displayed by the mixture of the former two colors.

When the voltage data output from the conversion table 19 changes to another value, e.g., "1000" corresponding to the voltage V4, the comparator 73 outputs the coincidence signal S of the level "0" as shown in FIG. 17B. The adder 75 directly outputs the voltage data "1000" output from the conversion table 19. The rounding unit 77 extracts the upper 3 bits "100" from the data "1000" and supplies the voltage data "100" to the D/A converter 21. The D/A converter 21 supplies the analog voltage V4 to the column driver 33, as shown in FIG. 17A. Consequently, the display color of the associated pixel becomes the color C4 corresponding to the voltage V4 as shown in FIG. 17D. The rounding unit 77 supplies the LSB "0" of the data "1000" to the second latch 79, which latches the input data as shown in FIG. 17C.

When the voltage data "1000" is read again from the conversion table 19, as shown in FIG. 17A, the comparator 73 outputs the coincidence signal S of the level "1" as shown in FIG. 17B. The adder 75 adds the voltage data "1000" from the conversion table 19 and the data "0" held in the second latch 79, and outputs the resultant data "1000." The rounding unit 77 extracts the upper 3 bits "100" from the data "1000" and supplies the voltage data "100" to the D/A converter 21. The D/A converter 21 supplies the analog voltage V4 to the column driver 33, as shown in FIG. 17A. Consequently, the display color of the associated pixel becomes the color C4 corresponding to the voltage V4 as shown in FIG. 17D. The rounding unit 77 supplies the LSB "0" of the voltage data "1000" to the second latch 79, which latches the input data as shown in FIG. 17C.

As a similar operation is repeated and every time the conversion table 19 continuously outputs the 4-bit voltage data "1000," the voltage V4 is supplied to the column decoder 33. The column decoder 33 samples the supplied voltage V4 and applies the sampled voltage to the associated pixel electrode 43.

Although the foregoing description of this embodiment has been given of the case where intermediate colors of the colors that can actually be displayed by the application of the voltages V0–V7 are displayed as approximated colors, the interval between actually displayable colors may be divided into multiple segments on the chromaticity diagram, thus increasing the number of approximated display colors, as illustrated with reference to FIG. 11. In this case, the applied voltages are arranged in such a manner that the average value of the applied voltages to a plurality of pixels becomes equal to the voltage to be applied to the liquid crystal in order to display the desirable color in view of the characteristic of the LCD device.

Figure 16:
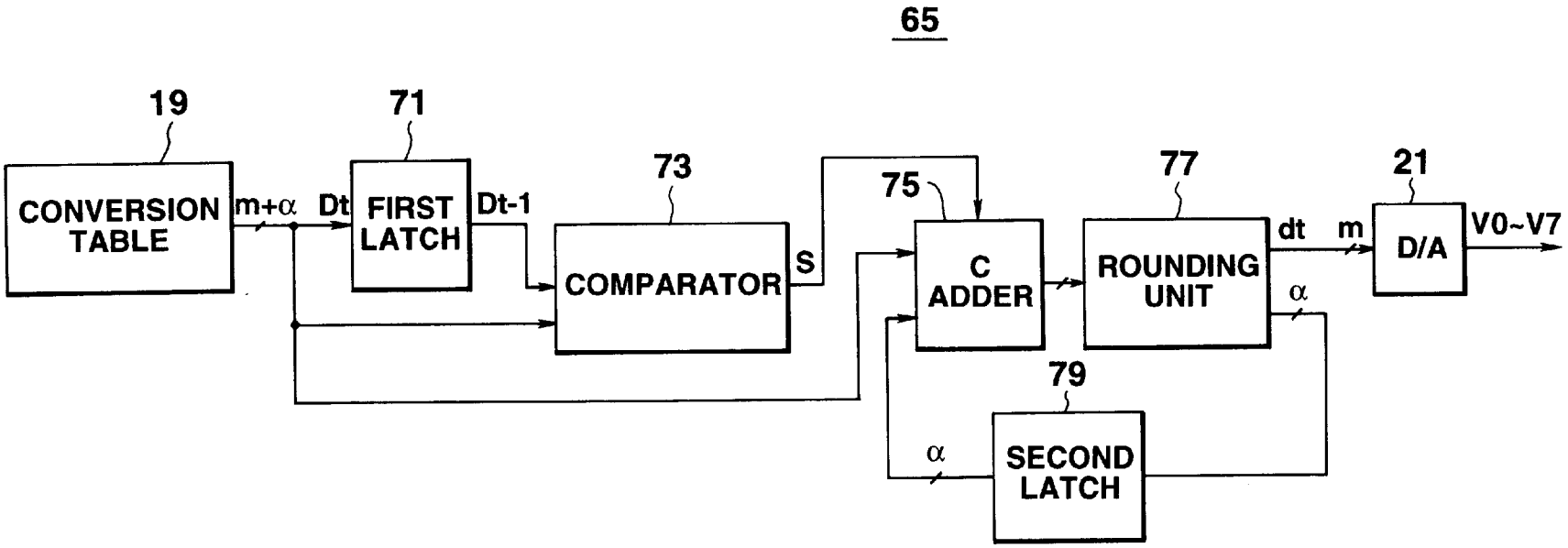
FIG. 16 is a diagram showing one example of the structure of the intermediate color controller shown in FIG. 12.

For example, by setting the voltage data output from the conversion table 19 to 5 bits and setting the number of bits, m and $\alpha$, of the intermediate color controller 65 having the structure shown in FIG. 16 to "3" and "2," respectively, the interval between actually displayable colors on the chromaticity diagram can be equally segmented by four to ensure the approximate display of the intermediate colors.

The number of types of voltages applicable to the LCD device 31 may be set greater than eight. In this case, the number of bits of voltage data output from the intermediate color controller 65 should be set equal to or greater than 4 bits and the number of bits of voltage data output from the conversion table 19 should be 4 bits plus the number of bits necessary to specify an approximated display color.

It is desirable that the interval between applied voltages be such that the characteristic between the applied voltages can be approximated by a straight line.

According to this embodiment, as described above, the colors, which are displayable in view of the characteristic of the LCD device but which are not actually displayable due to the limited number of applied voltages, can be displayed by mixing the colors of a plurality of pixels. It is therefore possible to display an image containing multiple colors with a limited number of drive voltages.

Although the output of the intermediate color controller 65 is subjected to D/A conversion in the D/A converter 21 to acquire an analog voltage to be applied to each pixel electrode 43 in this embodiment, another method may be employed as well.

For example, the voltage generator 61, which comprises a power supply circuit or the like for outputting the voltages V0–V7, may be provided, and the output voltage of the voltage generator 61 may be selectively supplied to the column driver 33 in accordance with the output data of the intermediate color controller 65 as in the second embodiment.

Fourth Embodiment

The display colors of an ECB type LCD apparatus depend on applied voltages, making it necessary to accurately set the applied voltages. Some users may prefer to change display colors. From this viewpoint, it is effective that the voltage generator 61 of the second embodiment is equipped with a voltage regulating capability.

Figure 18:
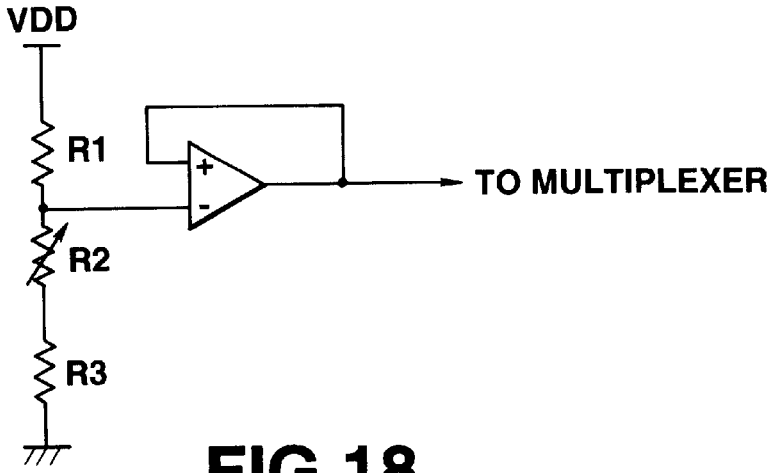
FIG. 18 is a circuit diagram showing an example of the structure of a voltage generator.

For example, the voltages V0–V7 may become variable by producing the voltages by using a voltage divider as shown in FIG. 18. Alternatively, the voltage generator 61 may comprise a capacitance dividing circuit using a variable capacitor to provide a variable output voltage.

Figure 19:
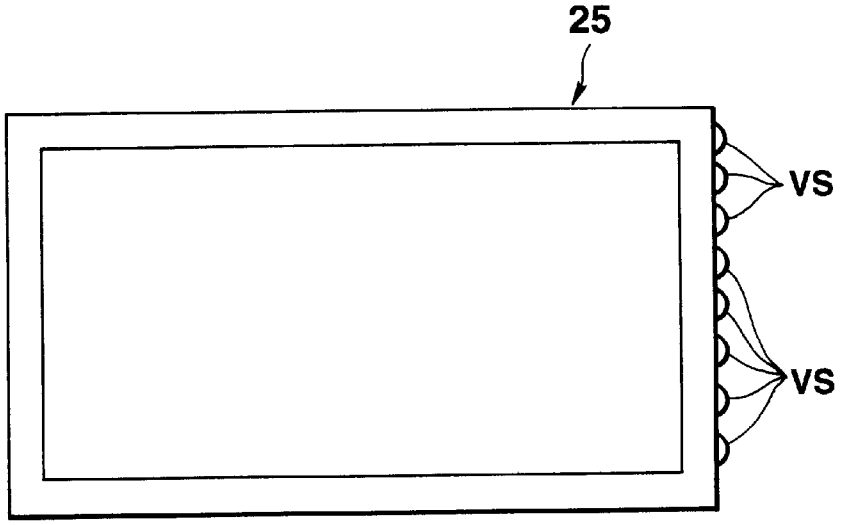
FIG. 19 is a diagram showing an example in which volume switches for adjusting voltages to be generated from the voltage generator are arranged on one side of the LCD apparatus.
Figure 20:
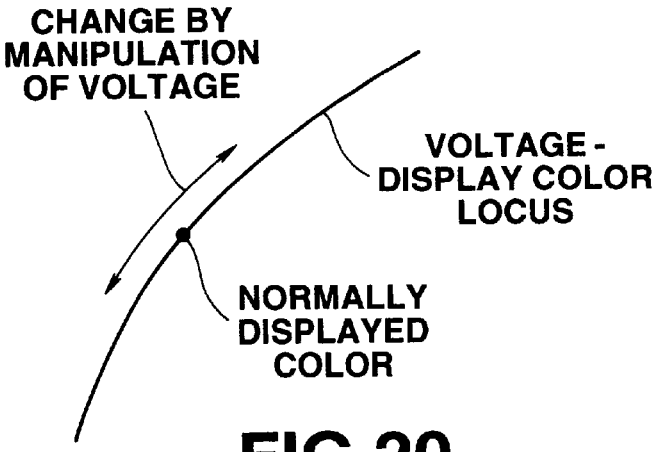
FIG. 20 is a diagram showing how a display color changes in accordance with the manipulation of the volume switches.

Volumes VS for adjusting voltages may be arranged on one side or the like of the LCD apparatus 25 as shown in FIG. 19. The user may operate the volumes VS to regulate the voltage applied to the pixel electrodes 43, thus adjusting the display colors.

The structure shown in FIG. 18 however complicates the adjustment and increases the consumed power.

Figure 21:
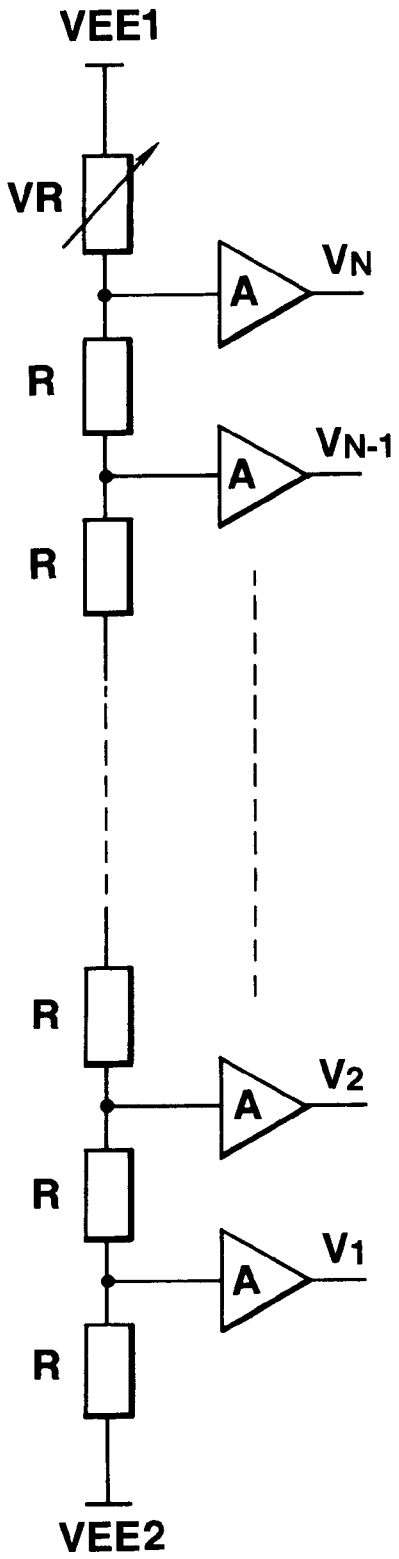
FIG. 21 is a circuit diagram exemplifying the structure of the voltage generator.
Figure 22:
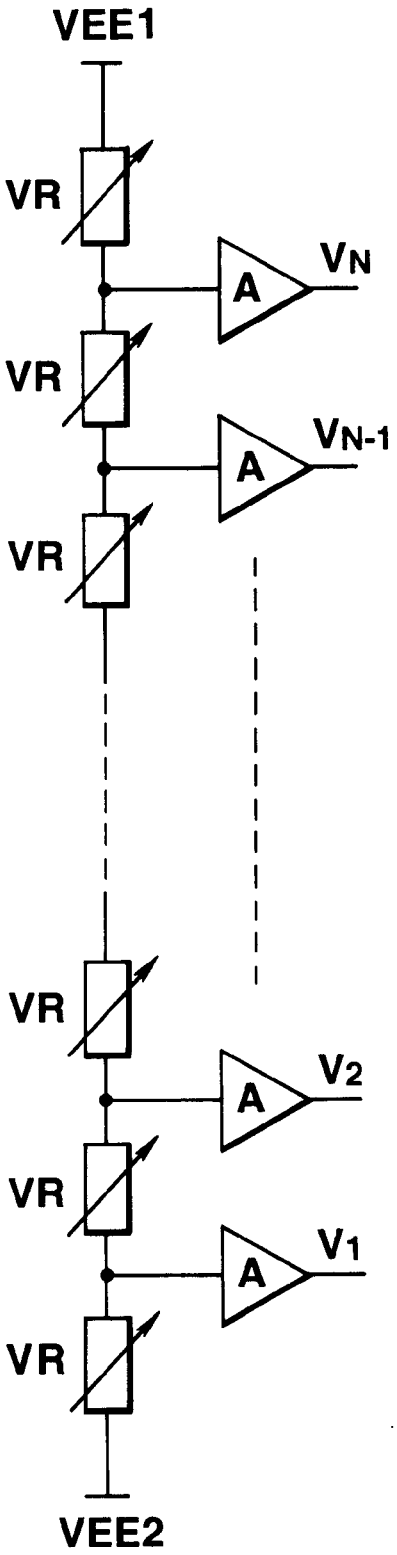
FIG. 22 is a circuit diagram showing another example the structure of the voltage generator.

Circuits shown FIGS. 21 and 22 may be used as the voltage generator.

In the example shown in FIG. 21, a plurality of resistors R are connected in series between supply voltages VEE1 and VEE2, and the voltage at each node between the resistors R is output as a drive voltage via an amplifier A. In this structure, only one resistor R is constituted of a variable resistor VR.

In the example shown in FIG. 22, a plurality of variable resistors VR are connected in series between supply voltages VEE1 and VEE2, and the voltage at each node between the variable resistors VR is output as a drive voltage via an amplifier A.

The voltage generator having the structure shown in FIG. 21 is suitable for an LCD device of an ordinary like the TN type, which changes the luminance in accordance with a change in applied voltage. The fine adjustment of each drive voltage is not however possible in this voltage generator. When this voltage generator is used for an ECB type LCD device which greatly changes both the display color and display gradation even by a slight voltage difference, it is not easy to acquire pleasant images.

Although the voltage generator having the structure shown in FIG. 22 can generate an output voltage having the accurate voltage value, it suffers a difficulty in adjusting the voltage.

A description will now be given of an embodiment of the most suitable voltage generator for driving an ECB type LCD device, with reference to the accompanying drawings.

Figure 23:
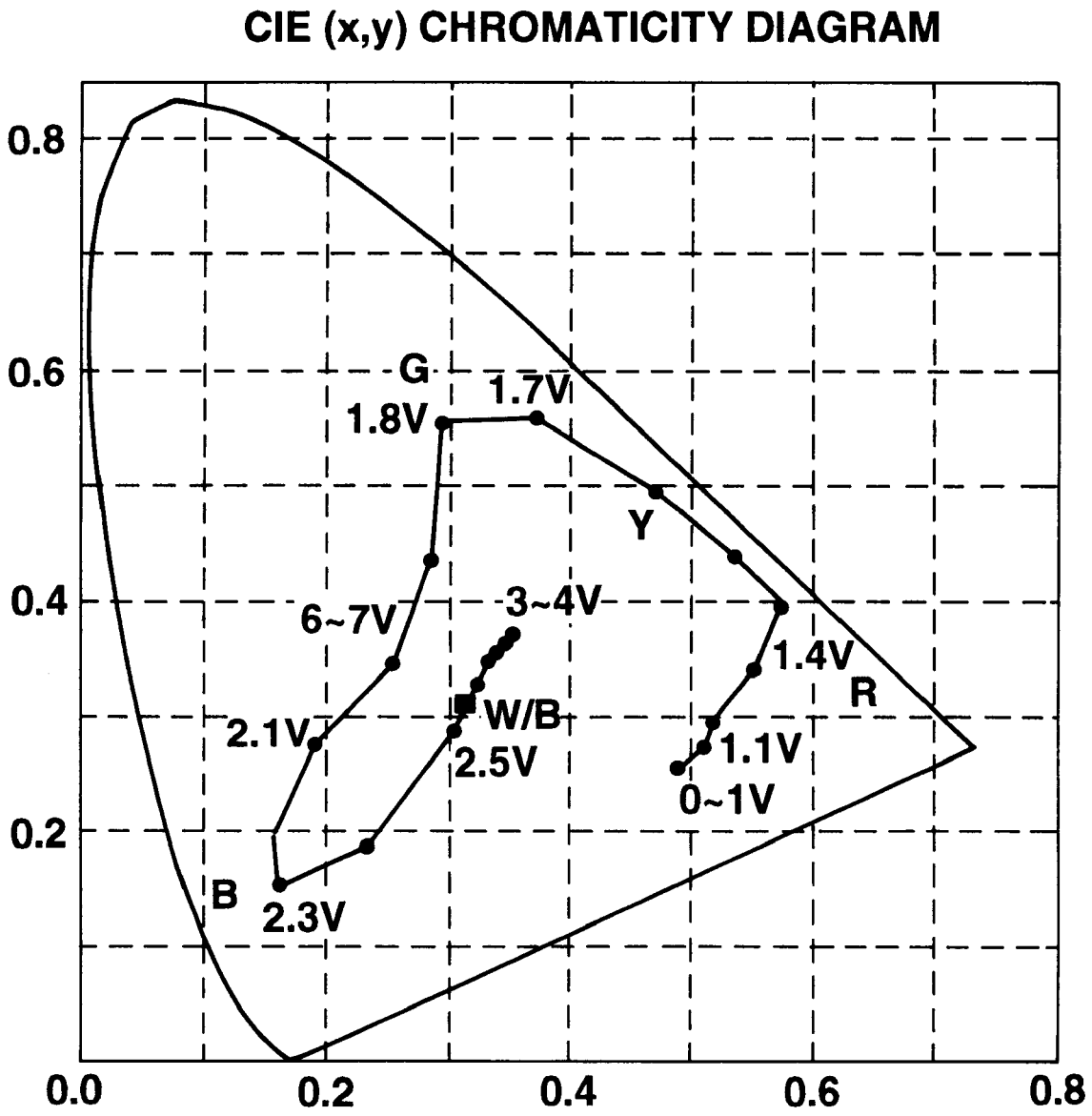
FIG. 23 is a CIE chromaticity diagram showing the detailed relation between applied voltages and display colors of the LCD device shown in FIG. 2.

FIG. 23 exemplifies a CIE (x, y) chromaticity diagram showing the relation between applied voltages and display colors of the LCD device 31.

In the example shown in FIG. 23, the display color "yellow" Y responds very sensibly to a change in applied voltage. More specifically, the applied voltage to display yellow has a very narrow range of about 0.1 V, causing the yellow color to vary by even a slight change in applied voltage. The display color "red" does not vary much even when the applied voltage changes.

A description will now be given of the structure of the voltage generator 61 suitable for driving the LCD device 31 having the above-described characteristic, with reference to FIG. 24.

Figure 24:
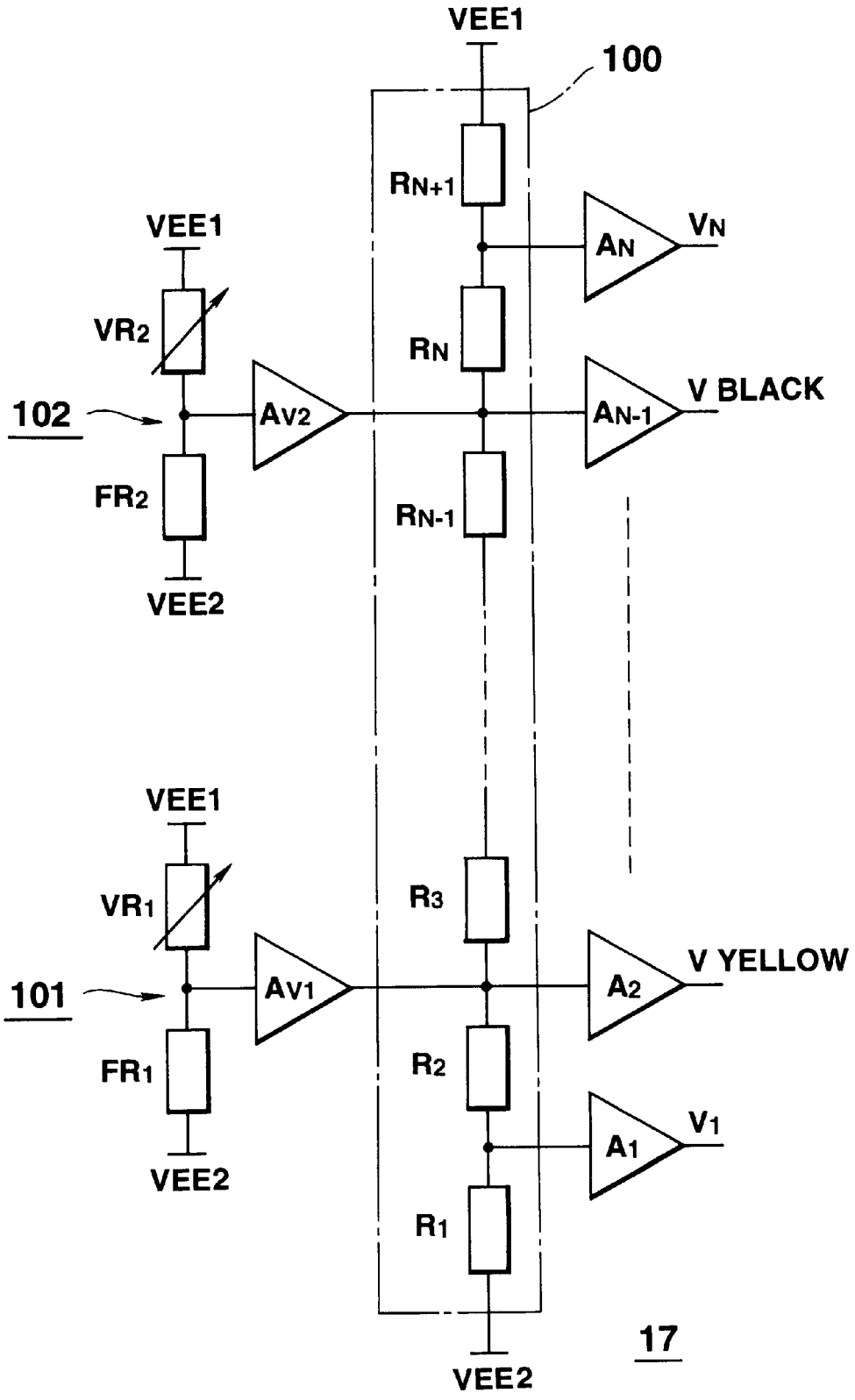
FIG. 24 is a circuit diagram of a voltage generator according to a fourth embodiment of this invention.

As shown in FIG. 24, the voltage generator 61 comprises a voltage divider 100, a first variable voltage circuit 101 and a second variable voltage circuit 102.

The voltage divider 100 is formed by connecting N+1 fixed resistors R having fixed resistances in series. The voltages at N nodes between the fixed resistors R are supplied as voltages $V_1$ to $V_N$ to the multiplexer 62 via amplifiers $A_1$ to $A_N$ for impedance conversion. The amplifiers $A_1$ to $A_N$ have a voltage amplification factor of 1. The resistances of the individual fixed resistors R need not be the same, but are properly set to acquire the desired voltages $V_1$ to $V_N$.

The voltages $V_1$ to $V_N$ serve to display the desired colors on the chromaticity diagram shown in FIG. 23. Of those voltages $V_1$ to $V_N$, the voltage $V_2$ is set to a voltage (Vyellow) for displaying yellow and the voltage $V_{N-1}$ is set to a voltage (Vblack) for displaying black.

The first variable voltage circuit 101 has a variable resistor (volume) $VR_1$ and a fixed resistor $FR_1$ connected in series between the supply voltages VEE1 and VEE2. The amplifier $A_{V1}$ has an input terminal connected to the node between the variable resistor $VR_1$ and the fixed resistor $FR_1$ and an output terminal connected to the node between the fixed resistors $R_2$ and $R_3$ of the voltage divider 100.

The voltage at the node between the variable resistor $VR_1$ and the fixed resistor $FR_1$ is set equal to the voltage Vyellow. The amplification factor of the amplifier $A_{V1}$ is set to "1" and the voltage at the node between the fixed resistors $R_2$ and $R_3$ of the voltage divider 100 is set equal to the voltage Vyellow.

The second variable voltage circuit 102 has a variable resistor (volume) $VR_2$ and a fixed resistor $FR_2$ connected in series between the supply voltages VEE1 and VEE2. The amplifier $A_{V2}$ has an input terminal connected to the node between the variable resistor $VR_2$ and the fixed resistor $FR_2$ and an output terminal connected to the node between the fixed resistors $R_N$ and $R_{N-1}$ of the voltage divider 100.

The voltage at the node between the variable resistor $VR_2$ and the fixed resistor $FR_2$ is set equal to the voltage Vyellow. The amplification factor of the amplifier $A_{V2}$ is set to "1" and the voltage at the node between the fixed resistors $R_N$ and $R_{N-1}$ of the voltage divider 100 is set equal to the voltage Vblack.

As the resistance of the variable resistor $VR_1$ is adjusted, the output voltage of the first variable voltage circuit 101 is changed, thus changing the voltage at the node between the fixed resistors $R_2$ and $R_3$ of the voltage divider 100 or the voltage Vyellow.

Likewise, as the resistance of the variable resistor $VR_2$ is adjusted, the output voltage of the second variable voltage circuit 102 is changed, thus changing the voltage at the node between the fixed resistors $R_N$ and $R_{N-1}$ of the voltage divider 100 or the voltage Vblack.

The drive voltages $V_3$ to $V_{N-2}$ are obtained by dividing the drive voltage Vyellow and drive voltage Vblack by the fixed resistors $R_3$ to $R_{N-1}$.

While the human vision is very sensitive to the display color "black" and can sensitively discriminate its change, the human vision does not respond to "gray" so much.

While the LCD device having the characteristic shown in FIG. 23 causes a sensitive change in "yellow" as the display color with respect to a voltage change and causes a color deviation with a slight voltage variation, the display color "red" does not respond to a voltage change so much.

It is therefore necessary to accurately adjust the drive voltages Vblack and Vyellow for displaying "black" and "yellow," and no significant problem would arise with respect to "gray" and "red" if the voltage is shifted from the reference value somewhat.

In the structure shown in FIG. 24, the voltage Vyellow output from the first variable voltage circuit 101 can be adjusted accurately by adjusting the variable resistor $VR_1$. The voltage Vblack output from the second variable voltage circuit 102 can be adjusted accurately by adjusting the variable resistor $VR_2$.

With regard to the other drive voltages, the voltages obtained by the voltage division by the fixed resistors $R_1$ to $R_{N+1}$ are used directly. Thus, those voltages cannot be adjusted finely. Even when those voltage slightly vary, the display colors of the LCD device do not change. Even if the display colors vary due to a voltage variation, human beings cannot sense it, thus raising no problem at all.

The structure of this embodiment permits voltage adjustment only on the voltages for displaying colors which drastically change with a voltage variation and the voltages for displaying colors to which human beings are very sensitive. It is therefore easy to adjust the display colors.

Although the drive voltages are led out from all the nodes between the fixed resistors $R_1$ to $R_{N-1}$ constituting the voltage divider 100 in the structure shown in FIG. 24, the applied voltage may be acquired only from some nodes.

Although the voltages at the nodes of the voltage divider 100 are set by the outputs of the first and second variable voltage circuits 101 and 102, the outputs of the first and second variable voltage circuits 101 and 102 may be output directly as the voltages Vyellow ($V_2$) and Vblack ($V_{N-1}$) and the other voltages may be obtained from the voltage divider 100.

Although the voltage divider 100 and the first and second variable voltage circuits 101 and 102 are constituted of resistors, they may be constituted of another type of impedance elements, such as capacitors.

Although the output of the voltage divider 100 is output via the amplifiers $A_1$–$A_{N+1}$ for impedance conversion, the amplifiers are not essential.

The structure for regulating the voltages is not limited to the particular type of the above-described embodiment, but other structures may also be employed as long as they can adjust the voltages at the necessary portions.

The voltage for displaying the color "black" to which human beings are very sensitive and the voltage for displaying the color "yellow" for which the LCD device is very sensitive to a voltage variation are adjustable in the above-described embodiment. Three or more voltage regulators to adjust "black," "yellow" and "blue," for example, may be provided. From the viewpoint of easier adjustment, it is desirable that the number of adjustable voltages should be equal to or less than a half of the number of actually produced voltages.

The foregoing description of this embodiment has been given with reference to an LCD device whose display color "yellow" is sensitive to a change in voltage. When another color is sensitive to a voltage change due to the viewpoint of the structure of the device, the voltage for producing that color should be made adjustable.

According to this embodiment, as described above, the display colors can be finely adjusted by regulating the applied voltages and the adjustment is easy.

The use of the power supply circuit of the fourth embodiment is not limited only to the LCD apparatuses of the second and third embodiments. This power supply circuit is effectively used in other ECB LCD apparatuses having other arbitrary structures. That is, this power supply circuit is not limited it its use to an LCD apparatus which displays an image based on RGB luminance signals, but may be adapted for use in variety of LCD devices which are supplied with a video signal exclusive for an ECB panel and which selectively apply an arbitrary voltage to the liquid crystal based on the video signal.

In the above-described embodiments, a table is used as the simplest means for converting image data to voltage data. But, the applied voltages-display colors characteristic shown in FIG. 5 or FIG. 8 may be stored in the form of a function in the memory and voltage data may be obtained by performing some calculations every time image data is supplied.

Although image data in use consists of two bits for each of RGB, a total of 6 bits, in the above-described embodiments, the number of bits is not fixed. Image data may consist of RGB image data and luminance data I indicative of the luminance. Image data may consist of data indicating the luminance of yellow, cyan and magenta. In this case, voltages for displaying displayable colors closest to the combined colors of the individual colors designated by yellow, cyan and magenta image data are set in the conversion table 19. Further, this invention may be widely applied to the case where an ECB type LCD device is driven by using image data which specifies a plurality of colors of different wavelength bands.

Although the illustrated examples of the above-described embodiments convert the RGB luminance signals to voltages to be applied to the individual pixels of the LCD device 31, TV video signals (composite video signals) of the NTSC system, or the like may be converted to voltages to be applied to the individual pixels of the LCD device LCD device 31 using a table.

In this case, a composite video signal may be converted to a digital composite video signal, and this digital signal may be temporarily converted to RGB luminance signals, which should be set in the conversion table 19. The conversion table 19 may be prepared for digital composite video signal.

In the first to fourth embodiments, for easier understanding, nothing has been discussed on the so-called polarity inversion for inverting the voltage for driving the LCD device 31 every predetermined period. However, the polarity of the voltage to be applied to the LCD device 31 may be inverted every line period, every field and so forth. In this case, the D/A converter 21 converts voltage data to voltages having positive and negative polarities, and one of the voltages is selectively supplied to the column driver 33 via some proper switching circuit. The voltage generator 61 converts voltage data to voltages V0 to V7 of both polarities one of which is selected by the multiplexer 62. The selected voltage is supplied to the column driver 33. The voltage to the opposing electrode 58 is also inverted in synchronism with the inversion of the polarity of the write voltage. Those are the same operations as performed in the prior art.

In the LCD devices of the first to fourth embodiments, a nematic liquid crystal having the positive dielectric anisotropy is aligned twisted in the LC cell. However, this invention may be adapted for various other types of display devices, such as a DAP (Deformation of Aligned Phase) type which uses a cell having LC molecules in a homeotropic alignment, a parallel aligned nematic (homogeneous) type which uses a cell having LC molecules aligned in a twistless homogeneous form, an HAN (Hybrid Aligned Nematic) type which uses a cell having LC molecules aligned perpendicular on the surface of one substrate and parallel on the surface of the other substrate with the alignment continuously changing between both substrates, and an LC alignment mode type which uses a cell having an LC layer whose LC molecules change between the splay alignment and bend alignment in accordance with the applied voltage.

Although a retardation plate is used in the above-described embodiments, it may be omitted depending on the alignment of the liquid crystal molecules. This invention is not limited to a reflection type but may be adapted for use in a transparent type LCD device.

What is claimed is:

1. A liquid crystal display apparatus comprising:

a liquid crystal display device having a plurality of pixels, each of said pixels comprising an electrode facing an opposing electrode through a liquid crystal layer, and each of said pixels displaying one of a plurality of respective colors in accordance with respective applied voltages, on a pixel by pixel basis;

color designation means for outputting image data designating a desired display color for each pixel of said liquid crystal display device;

conversion means for memorizing relations between said image data and drive voltage data corresponding to voltages to be respectively applied to said pixels, and for converting said image data to drive voltage data in accordance with displayable colors which can be displayed by said pixels, said drive voltage data representing displayable colors respectively corresponding to the desired colors designated by said image data on a pixel by pixel basis; and drive means for supplying said pixels with respective drive voltages corresponding to said drive voltage data output from said conversion means, so as to respectively drive said pixels on a pixel by pixel basis to display said displayable colors respectively corresponding to the desired colors designated by said image data.

2. The liquid crystal display apparatus according to claim 1, wherein said conversion means outputs drive voltage data corresponding to displayable colors close to the desired colors designated by said image data.

3. The liquid crystal display apparatus according to claim 2, wherein said image data includes bits greater in number than bits of said drive voltage data.

4. The liquid crystal display apparatus according to claim 1, wherein said conversion means outputs one of: (i) drive voltage data corresponding to displayable colors closest on a color space to the desired colors designated by said image data; (ii) drive voltage data corresponding to displayable colors closest on a chromaticity diagram to the desired colors designated by said image data; (iii) drive voltage data corresponding to displayable colors lying in a same area in a color space; (iv) and drive voltage data corresponding to displayable colors lying in a same area on a chromaticity diagram.

5. The liquid crystal display apparatus according to claim 1, wherein said conversion means outputs said drive voltage data as a digital signal; and said drive means includes:

a digital-to-analog converter for converting said drive voltage data output from said conversion means to analog voltages; and means for outputting said analog voltages as said respective drive voltages.

6. The liquid crystal display apparatus according to claim 1, wherein said drive means includes:

voltage generating means for outputting a plurality of produced voltages; and a multiplexer for selecting, from said produced voltages, voltages corresponding to said drive voltage data output by said conversion means, and for outputting said selected voltages as said respective drive voltages.

7. The liquid crystal display device according to claim 6, wherein said voltage generating means includes variable means for changing a voltage value of an output voltage.

8. The liquid crystal display device according to claim 7, wherein said voltage generating means comprises:

fixed voltage means for producing a plurality of fixed voltages;

variable voltage means having a voltage-dividing circuit, including a variable impedance element, for producing a variable voltage; and output means for outputting respective voltages produced by said fixed voltage means and said variable voltage means as said respective drive voltages.

9. The liquid crystal display device according to claim 1, wherein said fixed voltage means includes a plurality of connected fixed impedance elements, and a voltage-dividing circuit having one end applied with a first voltage and a second end applied with a second voltage;

wherein said variable voltage means is connected to a predetermined node between said plurality of fixed impedance elements, and sets a voltage at said predetermined node to a desired value; and wherein said output means outputs said respective drive voltages from a plurality of nodes between fixed impedance elements of said voltage-dividing circuit.

10. The liquid crystal display apparatus according to claim 9, wherein said variable voltage means outputs at least one of: (i) a predetermined voltage within a voltage range in which a ratio of a change in a color to a change in applied voltage of said liquid crystal display device is large; and (ii) a voltage corresponding to a color for which visual sensitivity to a change in hue of said liquid crystal display device is high.

11. The liquid crystal display apparatus according to claim 10, wherein said variable voltage means outputs one of: (i) a voltage corresponding to black; and (ii) a voltage corresponding to yellow.

12. The liquid crystal display apparatus according to claim 1, wherein said color designating means includes:

an image memory for storing color data specifying said desired colors for each pixel of said liquid crystal display device;

execution means for executing an image preparing program and storing color data defining a color display in said image memory; and means for supplying said color data, stored in said image memory, to said conversion means.

13. The liquid crystal display apparatus according to claim 1, wherein said liquid crystal display device includes means for performing a display by a birefringence controlled optical effect.

14. The liquid crystal display apparatus according to claim 1, wherein said image data includes a set of data specifying a plurality of colors of different wavelength bands.

15. The liquid crystal display apparatus according to claim 1, wherein when said drive voltage data output from said conversion means specifies a voltage not applicable to said liquid crystal display device, said drive means sequentially applies a predetermined number of drive voltages in a vicinity of said inapplicable voltage to respective ones of said pixels, thereby displaying a color approximately close to a color corresponding to said inapplicable voltage data.

16. The liquid crystal display apparatus according to claim 1, wherein when said drive voltage data output from said conversion means repeatedly specifies a voltage not applicable to said liquid crystal display device, said drive means selects a predetermined number of drive voltages in a vicinity of said inapplicable voltage and sequentially applies said predetermined number of drive voltages to respective ones of said pixels, thereby displaying a color approximately close to a color corresponding to said drive voltage data in a form of mixed colors of said plurality of pixels.

17. The liquid crystal display apparatus according to claim 1, wherein when said drive voltage data output from said conversion means repeatedly specifies a voltage not applicable to said liquid crystal display device, said drive means selects two drive voltages which are in a vicinity of and respectively higher and lower than said inapplicable voltage, and alternately applies said two drive voltages to respective ones of said pixels.

18. A method of driving a liquid crystal display device having a plurality of pixels each comprising an electrode facing an opposing electrode through a liquid crystal layer, said method comprising:

an image data output step of outputting image data defining desired colors to be displayed;

a first conversion step of converting said image data to corresponding voltage data for displaying said desired colors defined by said image data;

a second conversion step of converting said voltage data to respective drive voltages corresponding to displayable colors which can be displayed by said pixels of said liquid crystal display device;

a drive step of supplying said drive voltages to respective pixels of said liquid crystal display device to display said displayable colors, corresponding to said desired colors defined by said image data, on a pixel by pixel basis.

19. The method according to claim 18, wherein said first conversion step includes a step of preparing a table storing a relation between said image data and voltages to be respectively applied to said pixels of said liquid crystal display device, and a step of converting said image data to said voltage data using said table.

20. The method according to claim 18, wherein said drive step includes:

a step of performing digital-to-analog conversion of said voltage data; and a step of supplying voltages obtained by said digital-to-analog conversion as said respective drive voltages.

21. The method according to claim 18, wherein said drive step includes:

a voltage producing step of producing a plurality of voltages;

a selection step of selecting voltages corresponding to said voltage data from said plurality of voltages produced in said voltage producing step; and a step of outputting said selected voltages as said respective drive voltages.

22. The method according to claim 21, wherein said voltage producing step includes a step of changing a voltage value of an output voltage.

23. The method according to claim 18, wherein said drive step includes a step of, when said voltage data specifies a color not corresponding to said drive voltage, supplying respective ones of said pixels with drive voltages whose average value becomes substantially equal to a voltage equivalent to said voltage data.

24. The method according to claim 18, wherein said image data includes primary color image data for defining said desired colors to be displayed; and said image data includes bits greater in number than bits of said voltage data.

* * * * *